US006082310A

United States Patent [19]

Valcic et al.

[11] Patent Number: 6,082,310

[45] **Date of Patent: *Jul. 4, 2000**

[54] AIR INLETS FOR WATER HEATERS

[75] Inventors: Zoran Valcic, Chatswood; Geoffrey Mervyn Whitford, Dundas; Brendan Vincent Bourke, Gordon, all of Australia

[73] Assignee: SRP 687 Pty. Ltd., Australia

[ * ] Notice: This patent is subject to a terminal disclaimer.

[21] Appl. No.: 09/241,279

[22] Filed: Feb. 2, 1999

Related U.S. Application Data

[60] Division of application No. 09/138,323, Aug. 21, 1998, which is a continuation-in-part of application No. 08/626,844, Apr. 3, 1996, Pat. No. 5,797,355.

[30] Foreign Application Priority Data

Apr. 4, 1995 [AU] Australia ..... 2136
Sep. 22, 1995 [AU] Australia ..... 5591

[51] Int. Cl.[7] ..... F22B 5/04; F24H 1/18

[52] U.S. Cl. ..... 122/14; 122/17; 126/350 R; 431/22; 431/346

[58] Field of Search ..... 122/5, 51, 13.1, 122/14, 17, 18; 126/42, 350 R; 431/22, 346, 354

[56] References Cited

U.S. PATENT DOCUMENTS

| | | |
|---|---|---|
| 360,199 | 3/1887 | Boegler . |
| 626,454 | 6/1899 | Brintnall . |
| 736,153 | 8/1903 | Reynolds . |
| 796,924 | 8/1905 | McCartney . |
| 1,398,986 | 12/1921 | Warnock . |
| 1,661,193 | 3/1928 | Newport . |
| 1,692,839 | 11/1928 | Humphrey . |
| 1,806,216 | 5/1931 | Plummer . |
| 1,841,463 | 1/1932 | Barber et al. . |
| 2,008,155 | 7/1935 | Ramsdell et al. . |
| 2,036,136 | 3/1936 | Guarcello . |
| 2,070,535 | 2/1937 | Hansen . |
| 2,112,655 | 3/1938 | Morrow . |
| 2,429,916 | 10/1947 | Belgau . |
| 2,479,042 | 8/1949 | Gaines . |
| 2,499,636 | 3/1950 | Finley . |
| 2,559,110 | 7/1951 | Burwell . |
| 3,139,067 | 6/1964 | Van Den Brock et al. . |
| 3,161,227 | 12/1964 | Goss et al. . |
| 3,741,166 | 6/1973 | Bailey . |

(List continued on next page.)

FOREIGN PATENT DOCUMENTS

| | | |
|---|---|---|
| 0 560 419 A2 | 9/1993 | European Pat. Off. . |
| 0 596 555 A1 | 5/1994 | European Pat. Off. . |
| 0 657 691 A1 | 6/1995 | European Pat. Off. . |
| 25 40 709 A1 | 3/1977 | Germany . |
| 39 26 699 A1 | 2/1991 | Germany . |
| 60-134117 | 7/1985 | Japan . |
| 62-162814 | 7/1987 | Japan . |
| WO 94/01722 | 1/1994 | WIPO . |

OTHER PUBLICATIONS

"Flame Traps—a Technical Note" Journal of Mines, Metals & Fuels, Jul. 1987.

*Primary Examiner*—Denise L. Ferensic
*Assistant Examiner*—Gregory A. Wilson
*Attorney, Agent, or Firm*—Schnader Harrison Segal & Lewis

[57] ABSTRACT

A water heater includes a water container, a combustion chamber adjacent said water container having at least one inlet to admit air and extraneous fume species into the combustion chamber, at least one inlet comprising a metal plate having a thickness of about 0.4 to 0.6 millimeters and through which pass a plurality of ports, each port having a quenching distance not greater than about 0.6 mm, and being capable of confining ignition and combustion of the extraneous fume species within the combustion chamber; and a burner associated with the combustion chamber and arranged to combust fuel to heat water in the container.

30 Claims, 31 Drawing Sheets

U.S. PATENT DOCUMENTS 3,947,229 3/1976 Richter .
4,039,272 8/1977 Elliott .
4,080,149 3/1978 Wolfe .
4,177,168 12/1979 Denny et al. .
4,191,173 3/1980 Dedeian et al. .
4,204,833 5/1980 Kmetz et al. .
4,241,723 12/1980 Kitchen .
4,480,988 11/1984 Okabayashi et al. .
4,510,890 4/1985 Cowan .
4,519,770 5/1985 Kesselring et al. .
4,565,523 1/1986 Berkelder .
4,639,213 1/1987 Simpson .
4,641,631 2/1987 Jatana .
4,742,800 5/1988 Eising .
4,777,933 10/1988 Ruark .
4,790,268 12/1988 Eising .
4,817,564 4/1989 Akkala et al. .
4,823,770 4/1989 Loeffler .
4,863,370 9/1989 Yokoyama et al. .
4,869,232 9/1989 Narang .
4,872,443 10/1989 Ruark .
4,893,609 1/1990 Girodani et al. .
4,919,085 4/1990 Ishiguro .
4,924,816 5/1990 Moore, Jr. et al. .
4,960,078 10/1990 Yokoyama et al. .
5,020,512 6/1991 Vago et al. .
5,044,928 9/1991 Yokoyama et al. .
5,085,205 2/1992 Hall et al. .
5,197,456 3/1993 Ryno .
5,205,731 4/1993 Reuther et al. .
5,215,457 6/1993 Sebastiani .
5,240,411 8/1993 Abalos .
5,246,397 9/1993 Petter .
5,261,438 11/1993 Katchka .
5,317,992 6/1994 Joyce .
5,335,646 8/1994 Katchka .
5,355,841 10/1994 Moore, Jr. et al. .
5,368,263 11/1994 Harrison .
5,385,467 1/1995 Sebastiani et al. .
5,397,233 3/1995 Eavenson et al. .
5,405,263 4/1995 Gerdes et al. .
5,427,525 6/1995 Shukla et al. .
5,435,716 7/1995 Joyce .
5,448,969 9/1995 Stuart et al. .
5,494,003 2/1996 Bartz .
5,520,536 5/1996 Rodgers et al. .
5,522,723 6/1996 Durst et al. .
5,531,214 7/1996 Cheek .
5,556,272 9/1996 Blasko et al. .
5,575,274 11/1996 DePalma .
5,588,822 12/1996 Hayakawa .
5,649,821 7/1997 Fogliani et al. .
5,649,822 7/1997 Gertler et al. .
5,674,065 10/1997 Grando et al. .
5,791,298 8/1998 Rodgers .
5,797,358 8/1998 Brandt et al. .
5,937,796 8/1999 Sebastiani .
5,941,200 8/1999 Boros et al. .

AIR INLETS FOR WATER HEATERS

RELATED APPLICATION

This application is a divisional of application Ser. No. 09/138,323, filed Aug. 21, 1998, incorporated herein by reference, which application is a continuation-in-part of application Ser. No. 08/626844 filed Apr. 3, 1996, now U.S. Pat. No. 5,797,355.

FIELD OF THE INVENTION

The present invention relates to air inlets for water heaters, particularly to improvements to gas fired water heaters adapted to render them safer for use.

BACKGROUND OF THE INVENTION

The most commonly used gas-fired water heater is the storage type, generally comprising an assembly of a water tank, a main burner to provide heat to the tank, a pilot burner to initiate the main burner on demand, an air inlet adjacent the burner near the base of the jacket, an exhaust flue and a jacket to cover these components. Another type of gas-fired water heater is the instantaneous type which has a water flow path through a heat exchanger heated, again, by a main burner initiated from a pilot burner flame.

For convenience, the following description is in terms of storage type water heaters but the invention is not limited to this type. Thus, reference to "water container," "water containment and flow means," "means for storing or containing water" and similar such terms includes water tanks, reservoirs, bladders, bags and the like in gas-fired water heaters of the storage type and water flow paths such as pipes, tubes, conduits, heat exchangers and the like in gas-fired water heaters of the instantaneous type.

A particular difficulty with many locations for water heaters is that the locations are also used for storage of other equipment such as lawn mowers, trimmers, snow blowers and the like. It is common for such machinery to be refueled in such locations.

There have been a number of reported instances of spilled gasoline and associated extraneous fumes being accidentally ignited. There are many available ignition sources, such as refrigerators, running engines, electric motors, electric light switches and the like. However, gas water heaters have sometimes been suspected because they often have a pilot flame.

Vapors from spilled or escaping flammable liquid or gaseous substances in a space in which an ignition source is present provides for ignition potential. "Extraneous fumes", "extraneous fumes species", "fumes", "extraneous gases" and the like are sometimes hereinafter used to encompass gases, vapors or fumes generated by a wide variety of liquid volatile or semi-volatile substances such as gasoline, kerosene, turpentine, alcohols, insect repellent, weed killer, solvents and the like as well as non-liquid substances such as propane, methane, butane and the like.

Many inter-related factors influence whether a particular fuel spillage leads to ignition. These factors include, among other things, the quantity, nature and physical properties of the particular type of spilled fuel. Also influential is whether air currents in the room, either natural or artificially created, are sufficient to accelerate the spread of fumes, both laterally and in height, from the spillage point to an ignition point yet not so strong as to ventilate such fumes harmlessly, that is, such that air to fuel ratio ranges are capable of enabling ignition are not reached given all the surrounding circumstances.

One surrounding circumstance is the relative density of the fumes. When a spilled liquid fuel spreads on a floor, normal evaporation occurs and fumes from the liquid form a mixture with the surrounding air that may, at some time and at some locations, be within the range that will ignite. For example, the range for common gasoline vapor is between 3% and 8% gasoline with air, for butane between 1% and 10%. Such mixtures form and spread by a combination of processes including natural diffusion, forced convection due to air current drafts and by gravitationally affected upward displacement of molecules of one less dense gas or vapor by those of another more dense. Most common fuels stored in households are, as used, either gases with densities relatively close to that of air (e.g. propane and butane) or liquids which form fumes having a density close to that of air, (e.g. gasoline, which may contain butane and pentane among other components, is very typical of such liquid fuel).

In reconstructions of accidental ignition situations, when gas water heaters are sometimes suspected and which involved spilled fuels typically used around households, it is reported that the spillage is sometimes at floor level and, it is reasoned, that it spreads outwardly from the spill at first close to floor level. Without appreciable forced mixing, the air/fuel mixture would tend to be at its most flammable levels close to floor level for a longer period before it would slowly diffuse towards the ceiling of the room space. The principal reason for this observation is that the density of fumes typically involved is not greatly dissimilar to that of air. Combined with the tendency of ignitable concentrations of the fumes being at or near floor level is the fact that many gas appliances often have their source of ignition at or near that level.

The invention aims to substantially raise the probability of successful confinement of ignition of spilled flammable substances from typical spillage situations to the inside of the combustion chamber.

SUMMARY OF THE INVENTION

The invention includes a water heater comprising a water container, adjacent which is a combustion chamber having one or more inlets to admit air and any extraneous flammable fume species which may have escaped in the vicinity of the water heater into its combustion chamber. In one particularly preferred form, an inlet comprises a metal plate having a thickness of about 0.4 to 1 millimeters and through which pass many ports, each of which has a quenching distance as defined not greater than about 0.6 mm. Because of choice of the quenching distance appropriate to several types of inlet plate the water heater is able to confine ignition and combustion of extraneous fume species within the combustion chamber, despite the presence of a burner(s) in the combustion chamber to combust fuel to heat the water in the container.

In an alternative form the inlet can take the form of a ceramic plate having a thickness in the range about 9 mm to 12 mm through which passes many ports each having a quenching distance of about 1.1 to 1.3 mm, which can likewise confine ignition and combustion of extraneous fumes to the combustion chamber.

BRIEF DESCRIPTION OF THE DRAWINGS

FIG. 13(*b*) is an elevational view projected from the air inlet shown in FIG. 13(*a*).

DETAILED DESCRIPTION OF THE INVENTION

Figure 1:
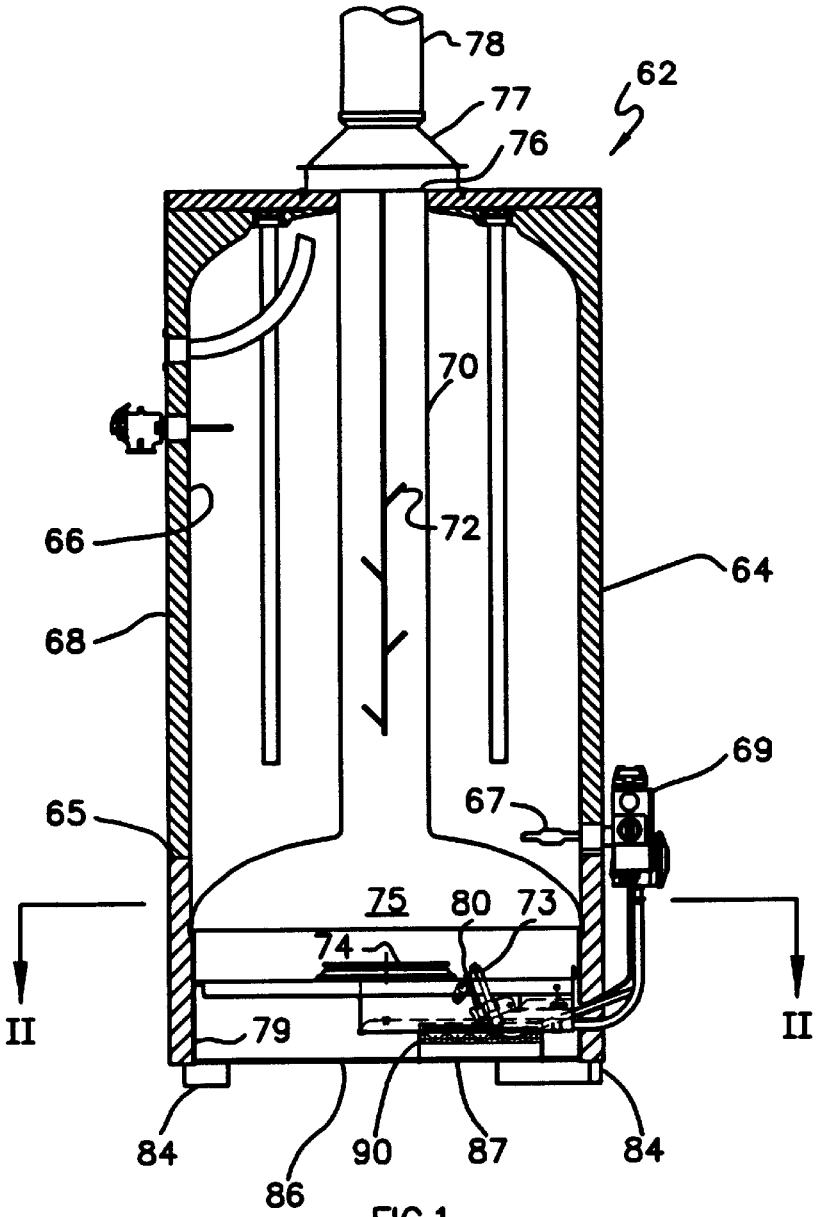
FIG. 1 is a schematic partial cross-sectional view of a gas-fuelled water heater having a single large air inlet according to the invention.

Conventional water heaters typically have their source(s) of ignition at a low level. They also have their combustion air inlets at or near floor level. In the course of attempting to develop appliance combustion chambers capable of confining flame inside appliances, we discovered that a type of air inlet constructed by forming holes in sheet metal in a particular way has particular advantages in damage resistance when located at the bottom of a heavy appliance such as a water heater which stands on a floor. We further discovered that providing holes having well defined and controlled geometry assists reliability of the air intake and flame confining functions in a wide variety of circumstances.

A thin sheet metallic plate having many ports of closely specified size formed, cut, punched, perforated, etched, punctured and/or deformed through it at a specific spacing provides an excellent balance of performance, reliability and ease of accurate manufacture. In addition, the plate provides damage resistance prior to sale and delivery of a fuel burning appliance such as a water heater having such an air intake and during any subsequent installation of the appliance in a user's premises.

In experiments conducted with air intakes having a variety of port shapes and patterns formed through a thin metal plate it was observed that some variants were more effective than others in flame confinement function. Certain ones enabled a flame to burn in close contact with the inside surface of air inlet plate, thereby leading to substantial temperature rise of the plate on its outside surface, by heat conduction. In some instances, this was observed to involve a pulsating combustion phenomenon which enhanced heat release in the combustion chamber.

An excessive rise in temperature of the perforated plate in contact with the flame can transfer heat by conduction through the relatively thin metal plate to the extent that it can reach a sufficiently high temperature (on the order of 1250° F. or 675° C.) such that a failure might possibly occur under some conditions caused by hot surface ignition of the spilled fumes on the outside of the combustion chamber.

During experimentation, which was designed to create potential ignition conditions not likely to occur under normal operating conditions and, with a video camera filming the inside of the combustion chamber, a potential mode of failure was observed in some instances to involve flame retention more closely to the periphery of the inlet plate than in the center. Where the flames are closely retained the inlet plate becomes visibly hotter such as by becoming red, which indicates a temperature in excess of 1250° F. and which was confirmed by thermocouple based temperature measurement.

The invention addresses ways of meeting extreme conditions and keeping the overall temperature of the inlet plate to a level that will not encourage external ignition by excessive heating of portions of the inlet plate. The invention also addresses ways of avoiding detonation wave type ignition that we discovered propagates from the inside to the outside of the combustion chamber through the inlet plate under certain circumstances, by minimizing the amount of flammable fumes which may enter the combustion chamber before initial ignition inside the combustion chamber occurs; and, also, during prolonged combustion incidents, in controlling thermally induced resonance within the combustion chamber.

Working from the basis that a burner designed to heat the contents of a water heater of a given capacity in a satisfactorily short time requires a particular air flow rate for proper combustion of the gaseous fuel, the inventors found that the shape and the pattern of the ports in an air intake plate having the required air flow rate can be surprisingly significant in preventing detonation ignition and delaying or preventing temperature rise of the plate during prolonged combustion testing resulting from a spill. Furthermore, the inter-port spacing in the plate can be specified to minimize flash-through ignition, all other parameters being in a satisfactory range.

It will be appreciated that the following description is intended to refer to the specific embodiments of the invention selected for illustration in the drawings and is not intended to limit or define the invention, other than in the appended claims.

Figure 2:
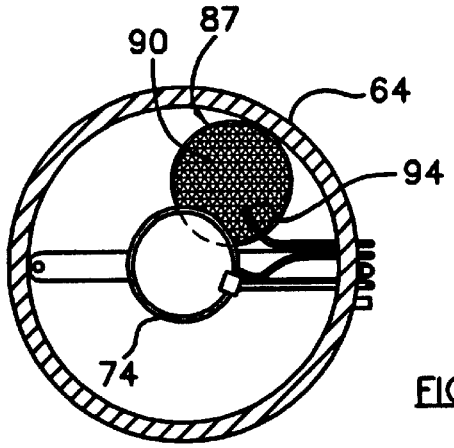
FIG. 2 is a cross-sectional view of a water heater of FIG. 1 taken through the line II—II in FIG. 1.

Turning now to the drawings in general and FIGS. 1 and 2 in particular, there is illustrated a storage type gas water heater 62 including jacket 64 which surrounds a water tank 66 and a main burner 74 in an enclosed chamber 75 that addresses and solves the longstanding problems described above. Water tank 66 is preferably capable of holding heated water at mains pressure and is insulated preferably by foam insulation 68. Alternative insulation may include fiberglass or other types of fibrous insulation and the like. Fiberglass insulation surrounds chamber 75 at the lowermost portion of water tank 66. It is possible that heat resistant foam insulation can be used if desired. A foam dam 65 separates foam insulation 68 and the fiberglass insulation.

Located underneath water tank 66 is a pilot burner 73 and main burner 74 which preferably use natural gas as their fuel or other gases such as LPG, for example. Other suitable fuels may be substituted. Burners 73 and 74 combust gas admixed with air and the hot products of combustion resulting rise up through flue 70 possibly with heated air creating a suction that draws ambient air into the combustion chamber 75, as will be further described below. Water tank 66 is lined with a glass coating for corrosion resistance. The thickness of the coating on the exterior surface of water tank 66 is about one half of the thickness of the interior facing surface to prevent "fish scaling". Also, the lower portion of flue 70 is coated inside to prevent eventual formation of scale that could detach and fall into chamber 75.

The fuel gas is supplied to both burners 73 and 74 through a gas valve 69. Flue 70 in this instance, contains a series of baffles 72 to better transfer heat generated by main burner 74 to water within tank 66. Near pilot burner 73 is a flame detecting thermocouple 80 which is a known safety measure to ensure that in the absence of a flame at pilot burner 73 the gas control valve 69 shuts off the gas supply. The water temperature sensor 67, preferably located inside the tank 66, co-operates also with the gas control valve 69 to supply gas to the main burner 74 on demand.

The products of combustion pass by natural convection upwardly and out the top of jacket 64 via flue outlet 76 after heat has been transferred from the products of combustion. Flue outlet 76 discharges conventionally into a draught diverter 77 which in turn connects to an exhaust duct 78 leading outdoors.

Water heater 62 is mounted preferably on legs 84 to raise the base 86 of the combustion chamber 75 off the floor. In base 86 is an aperture 87 which is closed gas tightly by an air inlet plate 90 which admits all required air for the combustion of the fuel gas combusted through the main burner 74 and pilot burner 73, regardless of the relative proportions of primary and secondary combustion air used by each burner.

Air inlet plate 90 is preferably made from a thin metallic perforated sheet of stainless steel. Copper or brass sheet metal can be used to take advantage of their superior heat conducting properties. Stainless steel when used may be surface treated such as by dipping in molten sodium dichromate and/or potassium dichromate, to blacken it and raise its emissivity. Such increase in emissivity can assist in keeping the air inlet plate cooler in use. Alternatively, a ported ceramic tile of the SCHWANK type (registered trade mark) can be utilized although the robustness of thin perforated metal when compared to its good flow capacity is preferred. The ceramic tile type functions adequately as long as the porosity is suitable and it does not become damaged during assembly, transit, installation or use. Alternatively, a robust form of woven wire mesh may be used, subject to observance of restrictions in its specification, as will be described.

Where base 86 meets the vertical combustion chamber walls or skirt 79, adjoining surfaces can be either one piece or alternatively sealed thoroughly to prevent ingress of air or flammable extraneous fumes. Gas, water, electrical, control or other connections, fittings or plumbing, wherever they pass through combustion chamber wall 79 are sealed.

The combustion chamber 75 is air/gas tight except for means to supply combustion air and to exhaust combustion products through flue 70. Some alternative structure of the combustion chamber are shown schematically in FIGS. 33–35, which is discussed later.

Pilot flame establishment can be achieved by a piezoelectric igniter. A pilot flame observation window (not shown) can be provided which is sealed. Cold water is introduced at a low level of the tank 66 and withdrawn from a high level in any manner as already well known.

During normal operation, water heater 62 operates in substantially the same fashion as conventional water heaters except that all air for combustion enters through air inlet plate 90. However, if spilled fuel or other flammable fluid is in the vicinity of water heater 62 then some extraneous fumes from the spilled substance may be drawn through plate 90 by virtue of the natural draught characteristic of such water heaters. Air inlet 90 allows the combustible extraneous fumes and air to enter but confines combustion inside the combustion chamber 75.

The spilled substance is burned within combustion chamber 75 and exhausted through flue 70 via outlet 76 and duct 78. Because flame is confined by the air inlet plate 90 within the combustion chamber, flammable substance external to water heater 62 will not be ignited.

As best seen in FIG. 2, the inlet plate has mounted on or adjacent its upward facing surface a thermally sensitive fuse 94 in series in an electrical circuit with pilot flame proving thermocouple 80 and a solenoid coil in gas valve 69.

With reference to FIG. 1, the size of air inlet plate 90 is dependent upon the air consumption requirement for proper combustion to meet mandated specifications to ensure low pollution burning of the gas fuel. Merely by way of general indication, the air inlet plate of FIG. 1 should be conveniently about 3700 square mm in perforated area when fitted to a water heater having between 35,000 and 50,000 Btu/hr (approximate) energy consumption rating to meet US requirements for overload combustion.

Figure 3:
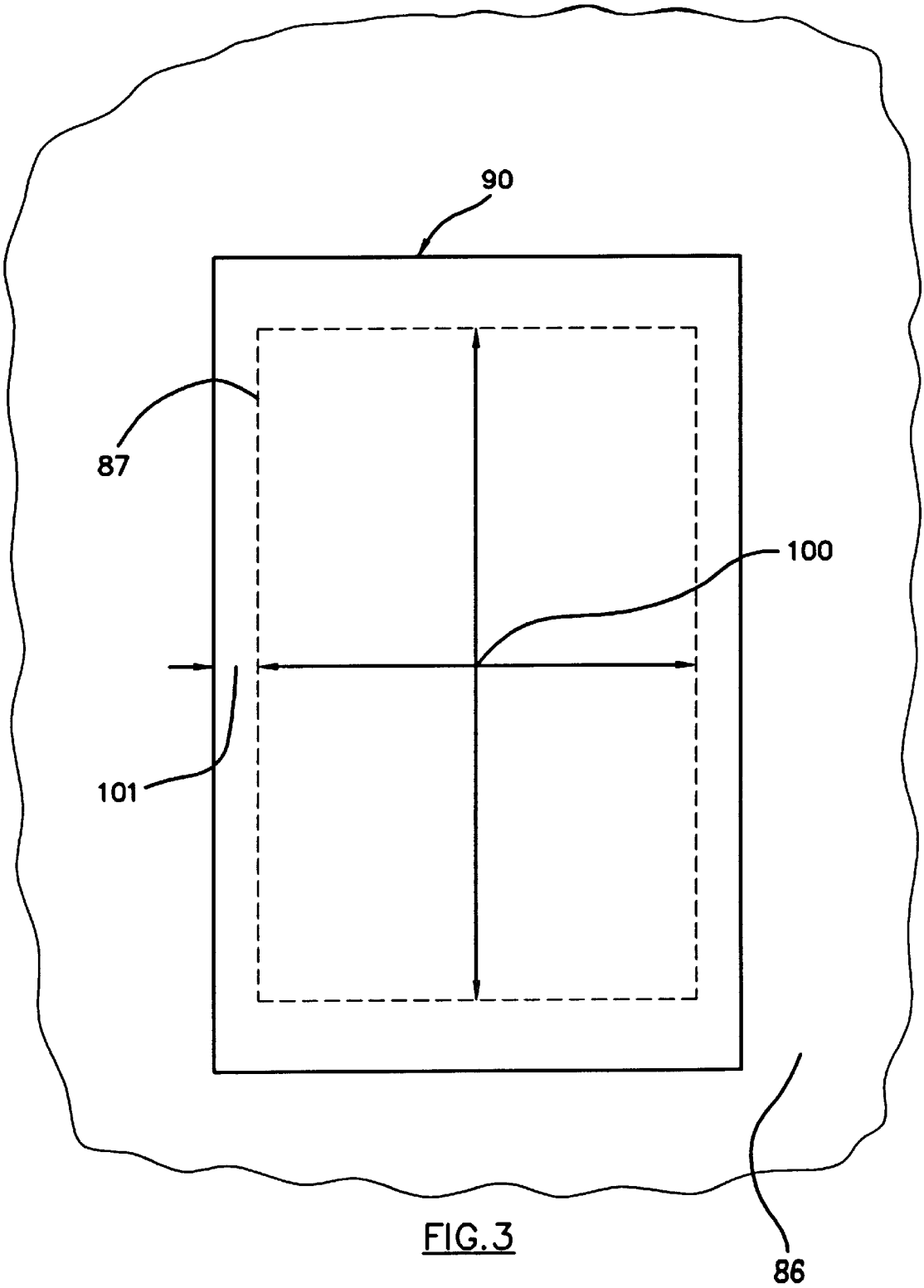
FIG. 3 is a schematic plan view depicting a portion of the base of a combustion chamber of a water heater including an air inlet.

FIG. 3 shows schematically an air inlet 90 to a sealed combustion chamber comprising an aperture 87 in a portion of the lower wall 86 of the combustion chamber and, overlapping the aperture 87, a thin sheet metal air inlet plate 90 having a perforated area 100 and an unperforated border 101.

Holes in the perforated area 100 of plate 90 can be circular or other shape although slotted holes have certain advantages as will be explained, the following description generally referring to slots.

FIG. 4 to FIG. 18 show in each case an air inlet plate 90 of various configurations as will be described to admit air to the combustion chamber 75. The air inlet plate 90 is a thin sheet metal plate having many small holes 103 or slots 104 passing through it. The metal may be stainless steel having a nominal thickness of about 0.5 mm although other metals such as copper, brass, mild steel and aluminum and thicknesses in the range about 0.3 mm to about 1 mm are suitable. Depending on the metal and its mechanical properties, the thickness can be adjusted within the suggested range. Grade 409, 430 and 316 stainless steel, having a thickness of about 0.45 mm to about 0.55 mm are preferred.

Figure 4:
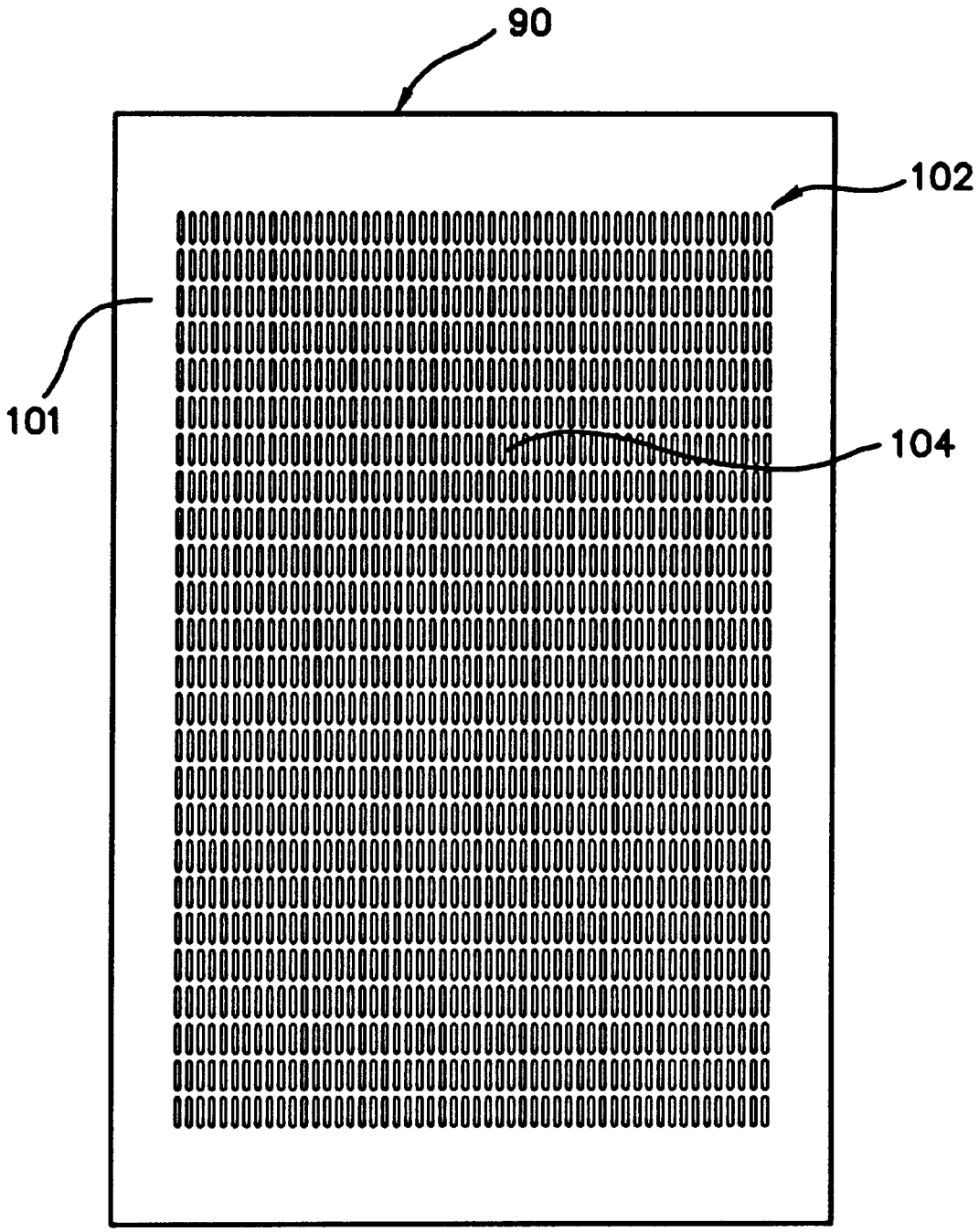
FIG. 4 is a schematic plan view of an air inlet according to the invention of a type which could be included in the FIG. 3. arrangement.
Figure 5:
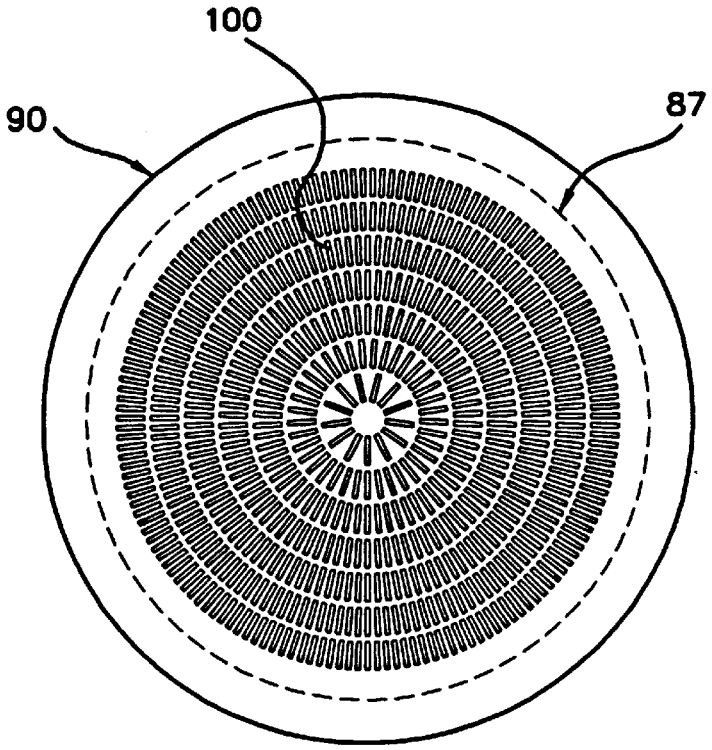
FIG. 5 is a schematic plan view depicting a portion of the base of a combustion chamber of a water heater substituting an air inlet of different shape and hole pattern.
Figure 6:
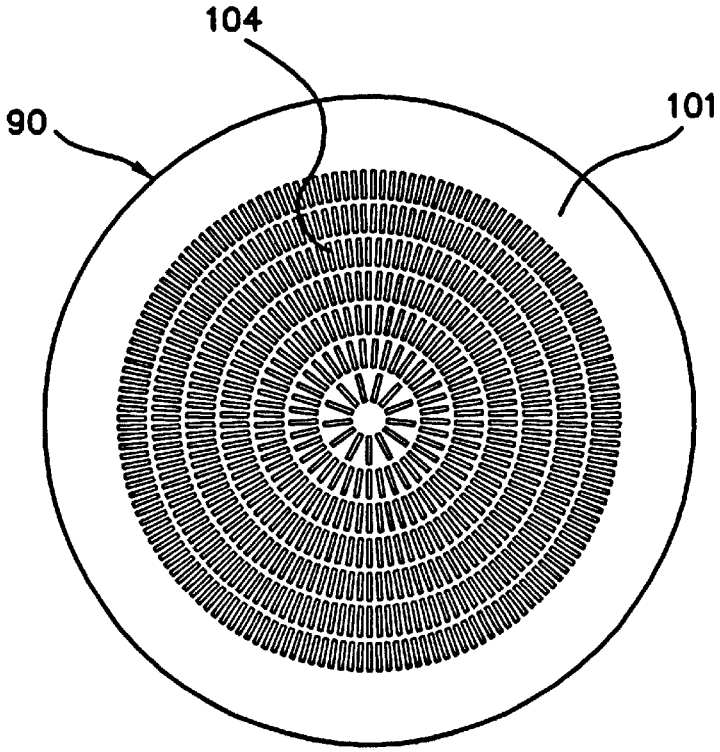
FIG. 6 is a schematic plan view of an air inlet according to the invention of a type which could be included in the FIG. 5 arrangement.
Figure 7:
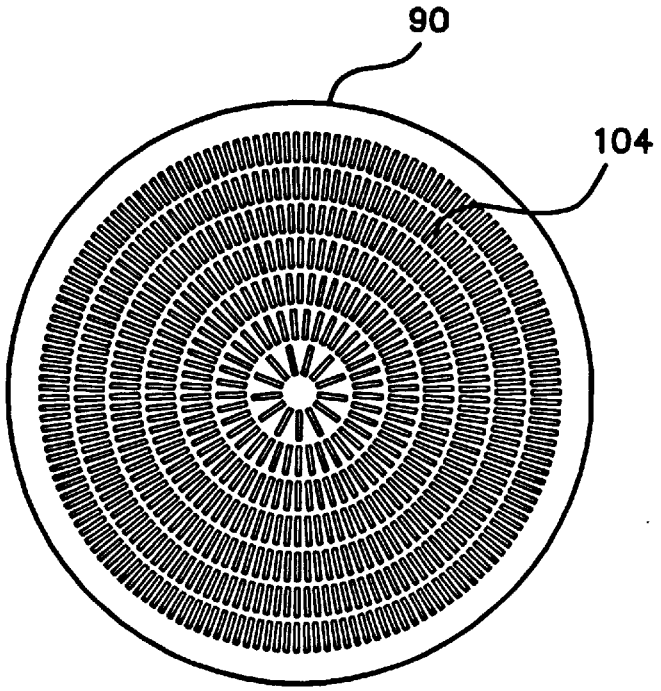
FIG. 7 is a plan view of an inlet plate showing a hole pattern applicable to an air inlet of the type shown in FIG. 6.
Figure 8:
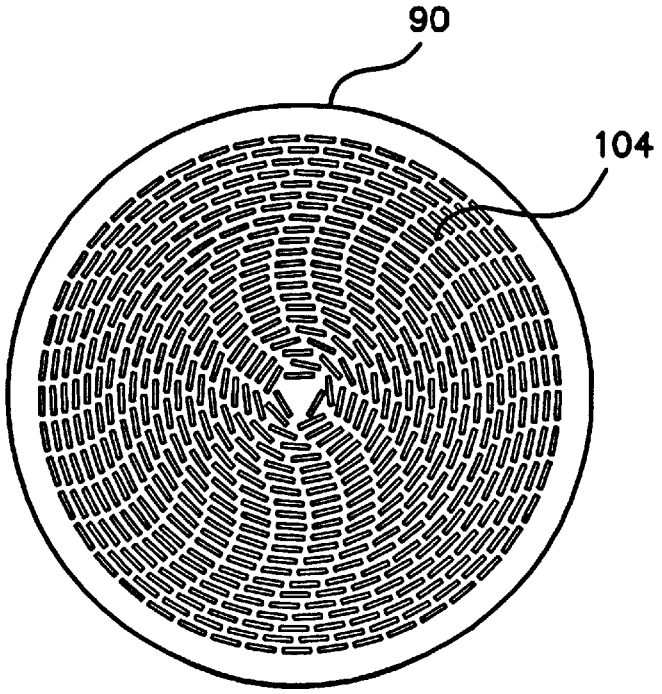
FIG. 8 is a plan view of an inlet plate showing a further hole pattern applicable to an air inlet of the type shown in FIG. 6.
Figure 9:
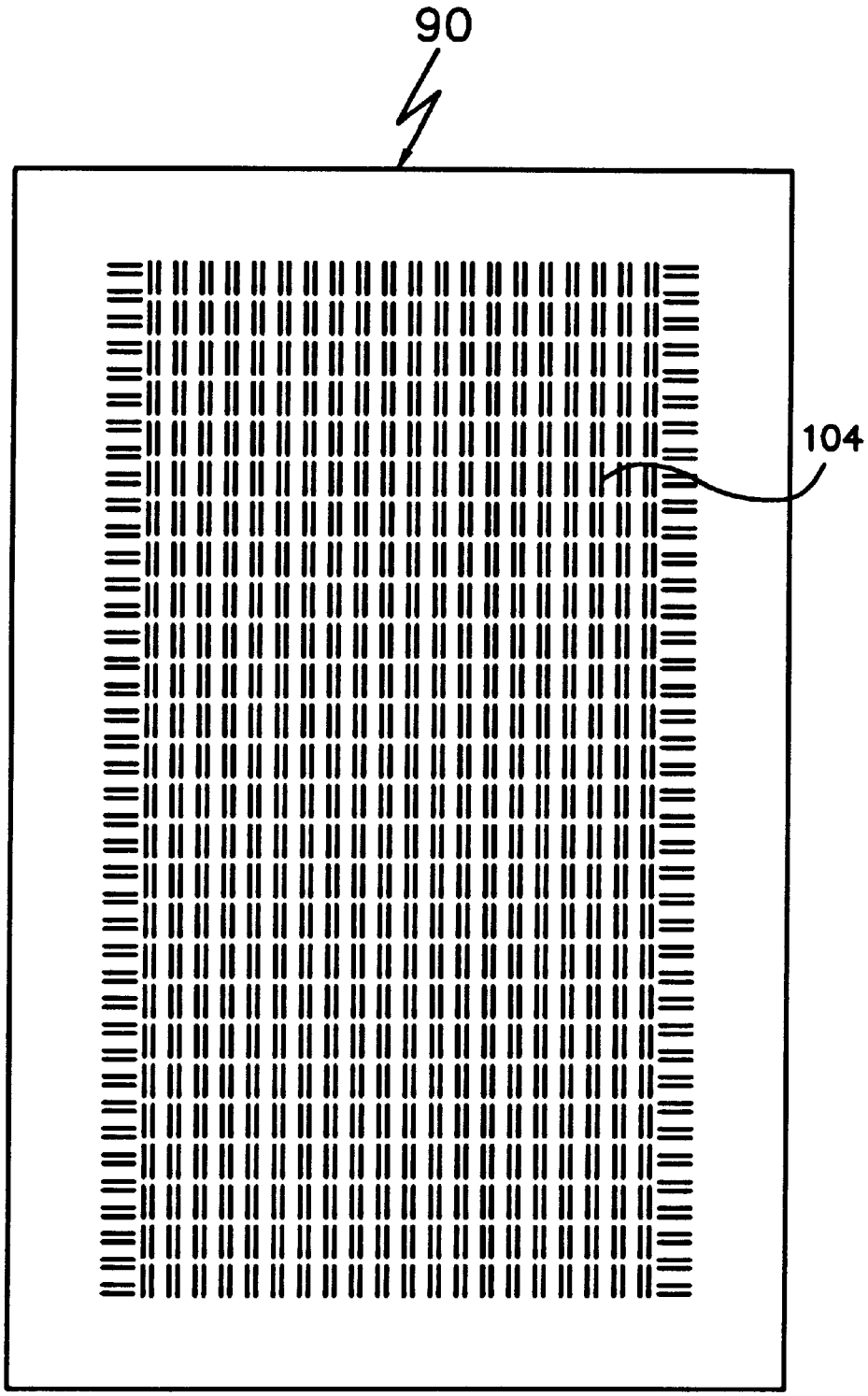
FIG. 9 is a plan view of ports on an inlet plate according to the invention of the embodiment shown in FIG. 3.

FIG. 4 is a plan view of an air inlet plate 90 having a series of ports in the shape of slots 104 aligned in rows. All such slots 104 have their longitudinal axes parallel. The ports are arranged in a rectangular pattern formed by the aligned rows. The plate is about 0.5 millimeters thick. This provides inlet plate 90 with adequate damage resistance and, in all other respects, operates effectively. The total cross-sectional area of the slots 104 is selected on the basis of the flow rate of air required to pass through the inlet plate 90 during normal combustion. For example, a gas fired. water heater rated at 50,000 BTU/hour requires at least 3,500 to 4,000 square millimeters of port space in plates of nominal thickness of approximately 0.5 mm.

FIGS. 4 to 18, 22, 24, 25 and 26 show numerous variations in the pattern of slots 104 in the perforated area 100, each variation representing one of many patterns which is suitable in the practice of this invention. In each illustration of a plate 90, a pattern of slots 104 and the size and shape of them constitutes an important consideration for optimum function in the event that extraneous flammable fumes accidentally enter with the air entering the combustion chamber 75. These structures minimize the possibility of ignition of a substantial or significant quantity of such spilled flammable volatile substance, such as gasoline, external to the combustion chamber.

Figure 10:
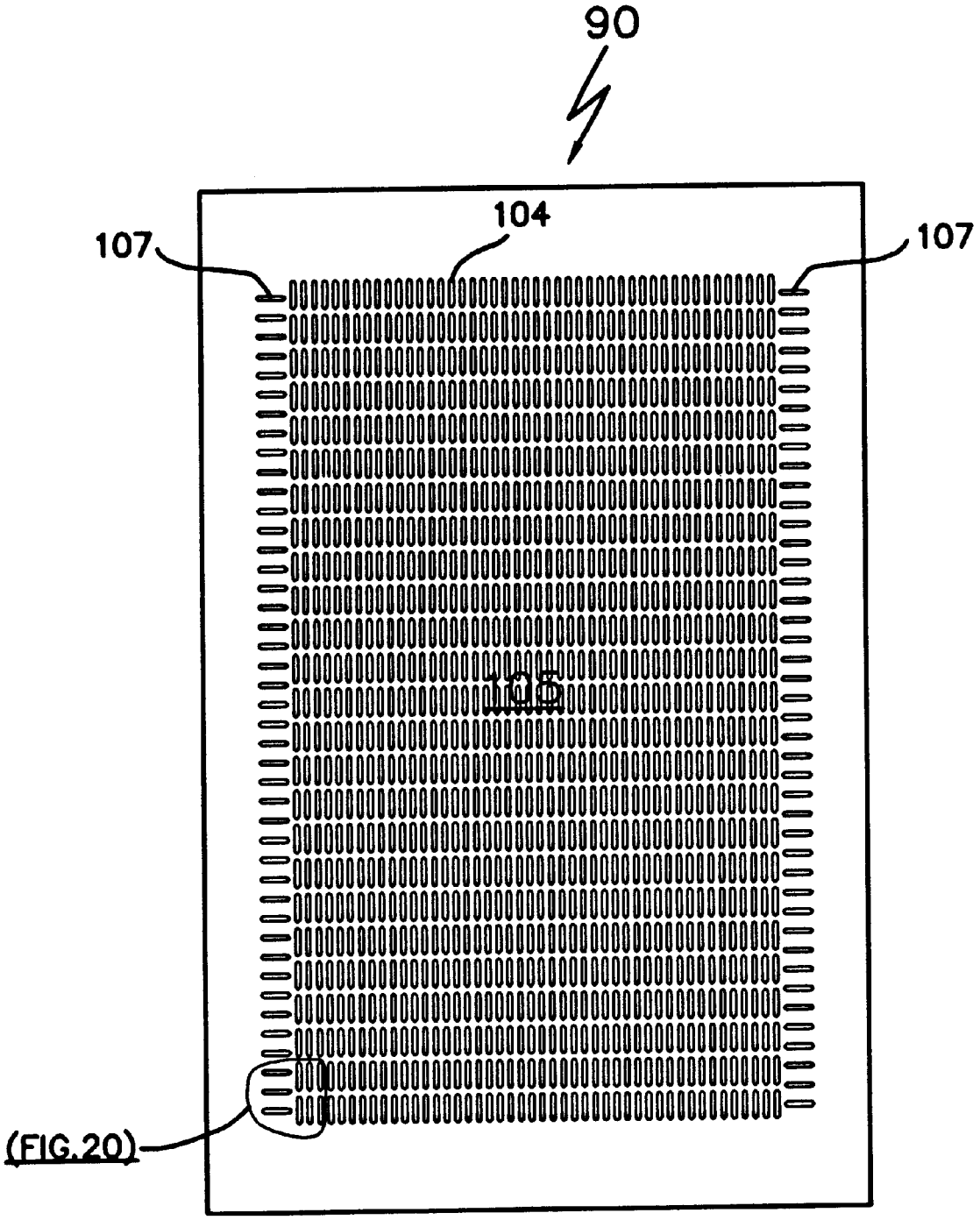
FIGS. 10 to 13(*a*) and 14 to 18 are each a further plan view of additional alternative patterns of ports on an inlet plate according to the invention of the embodiment shown in FIG. 3.

FIG. 10 shows one particularly suitable pattern with longitudinal axes of the edge slots 107 at right angles to those of the ports 104 in the remaining perforated area 105.

The slots 104 are provided to allow sufficient combustion air through the inlet plate 90 and there is no exact restriction on the total number of slots 104 or total area of the plate, both of which are determined by the capacity of a chosen gas (or fuel) burner to generate heat by combustion of a suitable quantity of gas with the required quantity of air to ensure complete combustion in the combustion chamber and the size and spacing of the slots 104. The air for combustion passes through the slots 104 and not through any larger inlet air passage or passages to the combustion chamber, no such larger air inlet being provided.

While FIGS. 4–13, 15–22, 24–26 and 31 illustrate ports which are elongated in shape, the present invention is applicable to inlet plates formed with circular ports 103 or other shaped ports 102 such as shown in FIGS. 14 and 42–44, for example.

To form the slots 104 or other form of port 102 one of several manufacturing operations are appropriate. Such operations include laser cutting, etching, photochemical machining, stamping, punching, blanking or piercing. A process of piercing and bending, sometimes referred to as lancing, can be used to produce a slot formed as shown in cross section in FIG. 22. In the process a tool punctures a line in a plate and a portion of the plate to one side of the line is then displaced laterally to create a slot of desired length and width W as shown.

Figure 11:
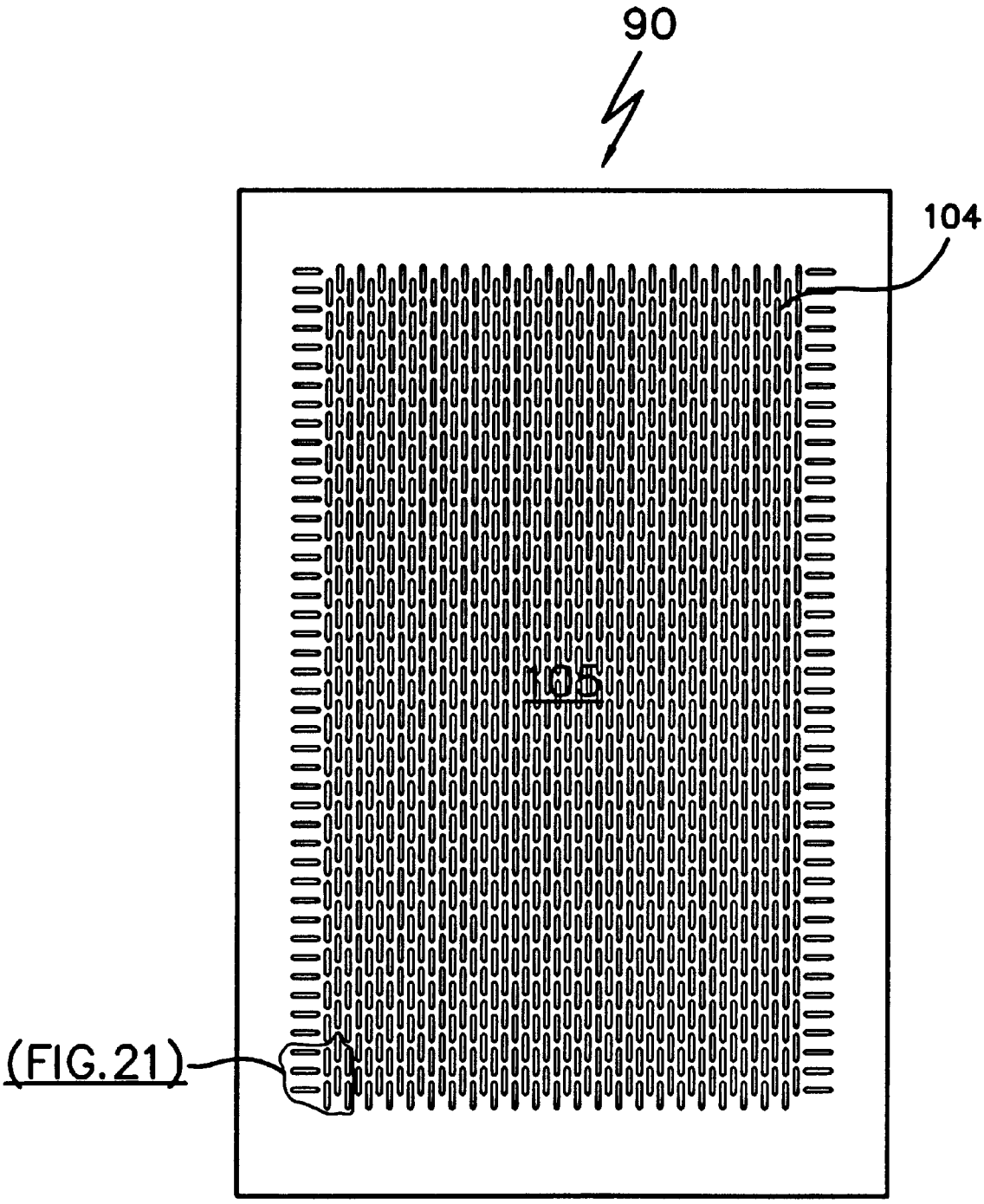

We find the pattern of FIG. 11 to have an advantage of good rigidity, favored by the off-set arrangement of adjacent rows of slots 1 to 4.

Figure 16:
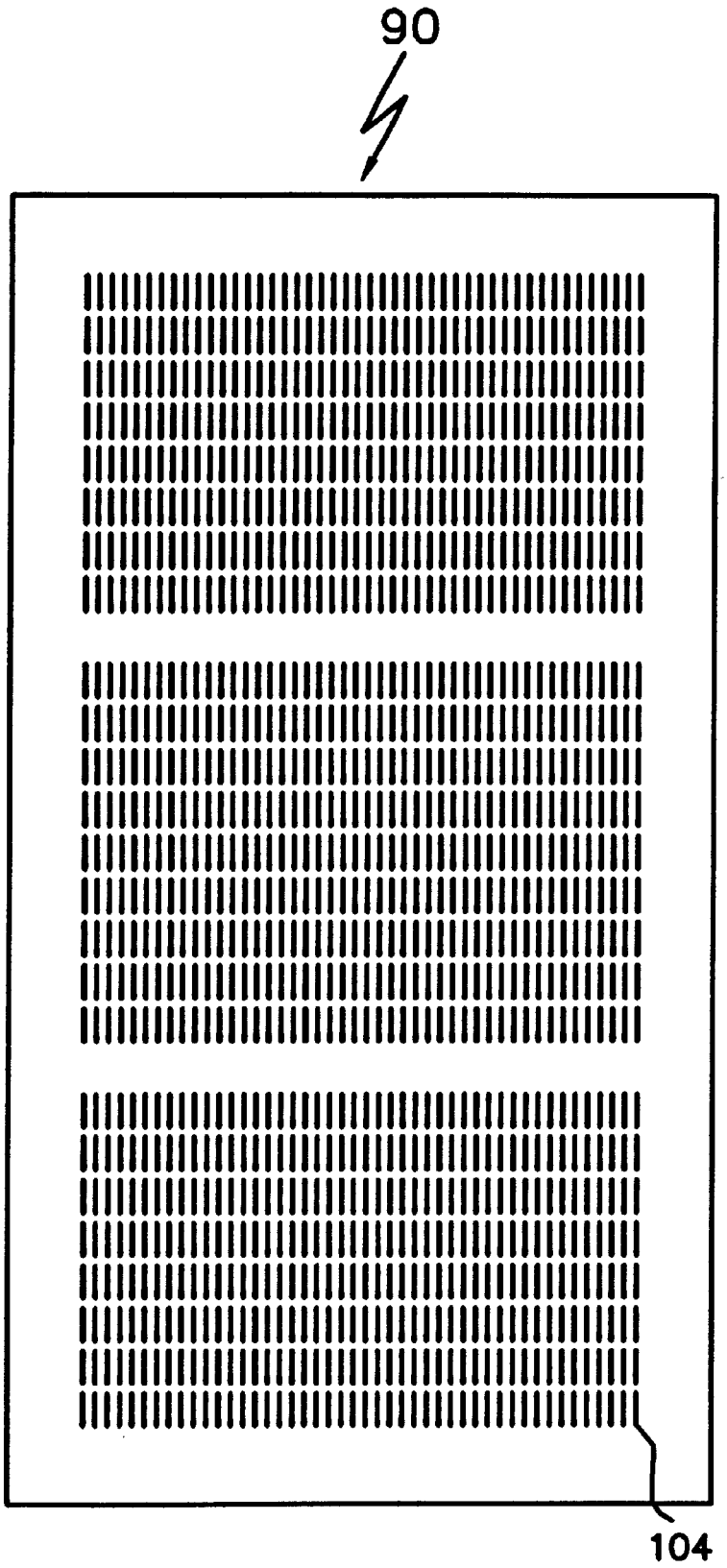
Figure 17:
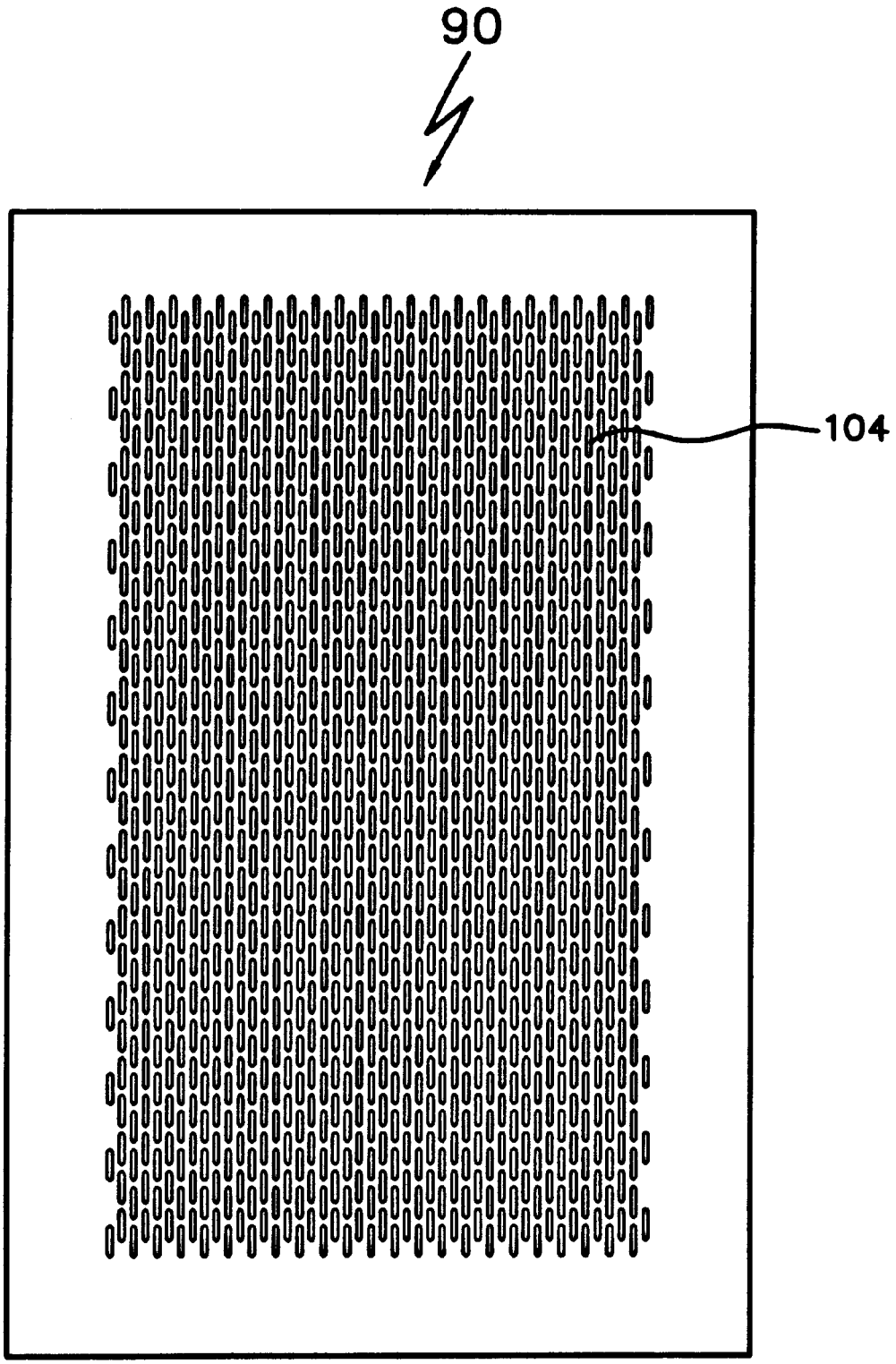
Figure 18:
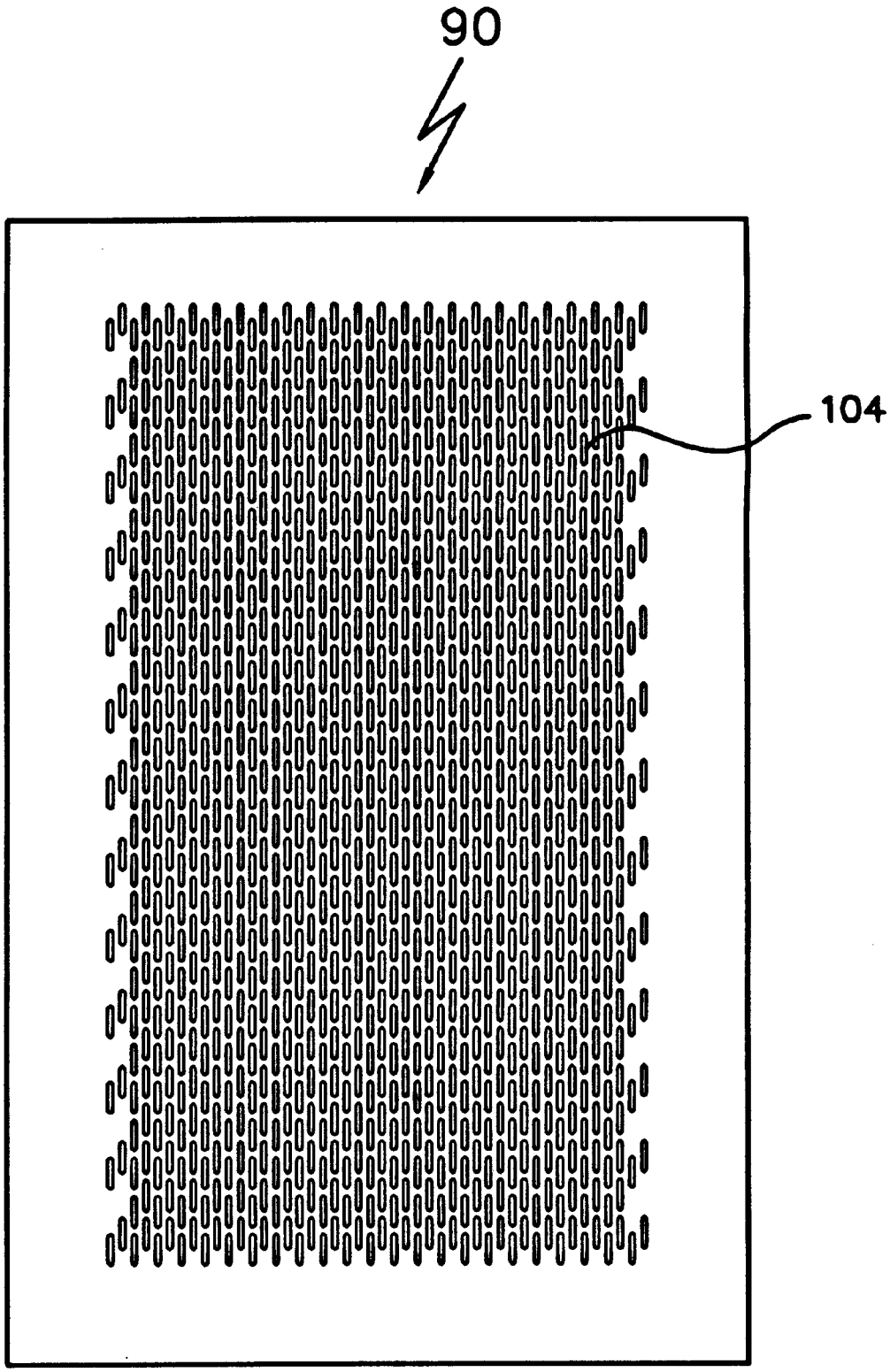

FIG. 16 shows a pattern divided into three discrete areas, by unperforated areas which may contain stiffening ribs as later described with reference to FIGS. 51(*a*)–(*c*).

Figure 19:
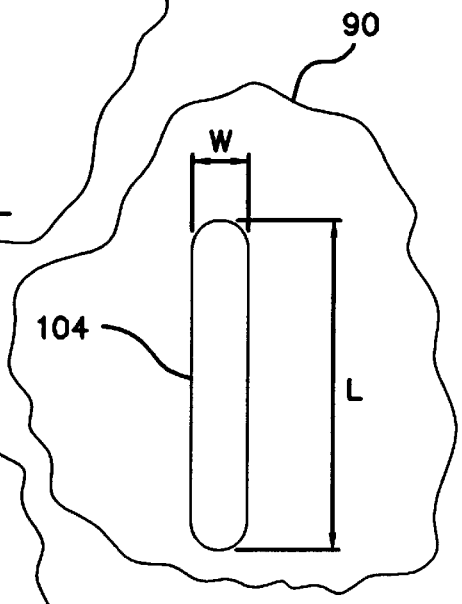
FIG. 19 illustrates a plan view of a single port as shown in FIGS. 10 to 18.

FIG. 19 shows a single slot 104 having a length L, width W and curved ends. To confine any incident of the above-mentioned accidental ignition inside the combustion chamber 75, the slots 104 are formed having at least about three times the length L as the width W and are preferably at least about twelve times as wide. Length to width (L/W) ratios outside these limits are also effective. We found that slots are more effective in controlling accidental detonation wave ignition than circular holes although beneficial effect can be observed with L/W ratios in slots as low as about 3. Above L/W ratios of about 15 there can be a disadvantage in that in a plate 90 of thin flexible metal possible distortion of one or more slots 104 may be possible as would tend to allow opening at the center of the slots creating a loss of dimensional control of the width W.

However, if temperature and distortion can be controlled then longer slots can be useful. Reinforcement of a thin inlet plate by some form of stiffening, such as cross-breaking, can assist adoption of greater L/W ratios. L/W ratios greater than about 15 are otherwise useful to maximize air flow rates and use of a thicker plate material than about 0.5 mm or a more highly tempered grade of steel, stainless steel or other chosen metal, can be expected to favor a choice of a ratio of about 20 to 30. Also the slot pattern shown in FIG. 11 favors a choice of a relatively high L/W ratio.

To perform their ignition confinement function, it is important that the slots 104 perform in respect of any species of extraneous flammable fumes which may reasonably be expected to be involved in a possible spillage external to the combustion chamber 75 of which the air inlet plate 90 of the invention forms an integral part or an appendage.

We define the "quenching distance" of a port in an inlet plate in a combustion chamber of a water heater or similar appliance to account for a wide variety of suitable shapes of port. The quenching distance in this context is that distance measured in the plane of the port area below which a flame formed by a combustible mixture of a fume species and air passing or having passed through the port in a forward direction will not propagate through the port in a reverse direction, whether as a result of detonation or deflagration type initiation of combustion or as a result of prolonged steady combustion at the inlet plate within the combustion chamber.

For shapes of ports such as may be categorized as geometrically regular such as circular holes or straight slots or irregular, such as curved or wavy slots, we define the quenching distance of such a port by first defining an axis of the open area of that port as the longer or longest line, which may be straight or curved, which divides that open area in half, exactly or approximately. The quenching distance of that port is then the length of the longest straight line that passes perpendicularly through the defined axis to meet the boundary of the open area. Thus the quenching distance according to this definition for a straight slot having semi-circular ends joining the longer sides is its width and, for a circle, its diameter. For the avoidance of doubt, in the case of four-sided figures where the longer axis could join diagonally opposite comers, the defined axis is that axis which bisects opposite sides. Thus, for a square for example the quenching distance is equal to the side length, not the diagonal.

For both geometrically regular and irregular shapes of port, complex patterns may be formed by superimposing shapes where axes may cross or intersect, in many ways, one example being wavy slots intersecting perpendicularly or, another, formed from straight lines creating an irregular star-like shape or the like.

Quenching diameters for circular tubes for various gas species at a pressure of one atmosphere and a temperature of 20° C. in a mixture with air have been determined and are tabulated below: (Reference: Jones, H.R.N. "The Application of Combustion Principles to Domestic Gas Burner Design," British Gas plc, 1989, p. 57, quoting Harris, J. A. & South, R, *Gas Engineering Management* 18, 153 (1978)).

| Gas | Quenching Diameter, mm |
|---|---|
| Methane | 3.5 |
| Ethylene | 1.8 |
| Ethane | 2.5 |
| Propane | 2.9 |
| Butane | 3.0 |
| Natural Gas | 2.7 |

(An alternative source, quotes 0.12 inches or 3.0 mm for butane, which is consistent but also lists an absolute minimum quenching distance of 1.78 mm which is not consistent with other data in Jones indicating that for methane, another hydrocarbon in the same family as butane, the minimum quenching distance is experienced with mixtures close to the stoichiometric ratio. See "Basic considerations in the combustion of hydrocarbon fuels with air," Barnett, H. C. & Hibbard, Robert R., eds., Report 1300 of The National Advisory Committee for Aeronautics, by Propulsion Chemistry Division, Lewis Flight Propulsion Laboratory, 1957).

We find that a quenching distance for either holes or slots in a thin metal plate (i.e., about 0.2 to 0.6 mm thick) is not more than about 0.6 mm. We have discovered that the following factors have an impact on the quenching distance that we prefer being reduced substantially in relation to the above tabulated values by reason of several variables.

Increase in temperature of a plate 90 and its immediate surroundings preheats the unburned gas/air mixture, which increases its burning velocity and reduces the quenching distance. Also, it has been discovered by other workers that preheating widens the flammability limits of a given gas species mixed with air. For example, in methane/air mixtures, at 200° C. a primary aeration as low as 55% is flammable but at 20° C. mixtures below 65% are not flammable. Other flammable substance/air mixtures show the same phenomenon as methane.

The quenching distance adopted for the slots 104 or other port 102 needs to be modified downwards to allow for preheating of the unburned extraneous fume/air mixture which inevitably obtains, although its intensity is variable depending on specific water heater design parameters and other variables associated with particular incidents. We recognize that flame speed increases with preheat of the unburned mixture and have read that for a mixture of butane (as a convenient example of an extraneous fume species) with air that the maximum flame temperature achievable is about 1900° C.

In our tests we measured typical air inlet plate temperatures at 675° C. maximum. Computer modelling of unburned gas passing through the highly preferred 0.5 mm by 6 mm long slots indicated a temperature of the unburned gases reaching 375° C. We believe that preheating causes the flame temperature (1900° C) to be increased by about the same amount as the preheat temperature, i.e., to about 2275° C. Using relationships familiar to those skilled in combustion engineering principles it would be estimated that for hydrocarbons such as propane or butane a reduction in quenching distance of about 30% is expected. This assumes, for example, that the temperature of the wall of the slot is the same as the temperature of the unburned fume/air mixture passing through. However, due to natural draft "pulling" the mixture through the plate 90 a heat transfer effect occurs and, therefore, the flow cools the surface of the plate to the extent that the red hot coloration visible on the combustion chamber side of the plate 90 was not measured in our experiments on the outside surface. Such temperatures would be well in excess of the hot surface ignition temperature of the particular extraneous fume species/air mixture.

Since combustion was observed to be confined within the combustion chamber the hot surface ignition temperature is not in practice attained. A further assumption made in estimating the 30% reduction in quenching distance is that the fume/air mixture is at the stoichiometric ratio. In the situations addressed by the present invention, the stoichiometric ratio over the period of combustion is not controlled given the random nature of accidental spillage situations wherein many different species of combustible extraneous fumes and arrival of potentially significant quantities of any or each at the inlet 90 to a fuel burning appliance desired to be rendered more safe, are random and unpredictable quantities spread over wide limits. Given the random nature of variations in these species and events and the possibility of pre-heat effects, we determined that estimates of a quenching distance to adopt were insufficient to achieve the safety level required by water heaters. We determined that a quenching distance not more than about 0.6 mm in a thin flat metal plate of about 0.5 mm thickness is preferred. There is a further preference for slots with an L/W ratio of at least about 3, but more preferably about 12, although in appropriate patterns it can be as high as about 20.

A quenching distance can best be determined according to the following factors:

- The incoming air and extraneous fume temperature, as affected by preheating;
- The ratio between extraneous fumes and air;
- The nature of the extraneous fumes in relation to its flame speed and flammability limits in combination with air as an oxidant;
- Appliance design related variables, including flue length and, therefore, the velocity of input air and extraneous fume mixtures and pressure difference across the air inlet plate 90;
- The depth and shape of the chosen air inlet ports 102;
- Internal construction of combustion chamber 75 relative to the main burner 74 positioning and the air inlet plate 90 positioning including effects of back radiation from the burner to the air inlet plate 90 and any other internal or external restrictions to air flow through the air inlet plate 90;
- The material of the flame trap including its thermal conductivity, the emissivity of its surface and the effect of any catalytic substance having combustion influence applied to its surface; and
- The effect of any combustion driven oscillation of the system as a whole; this can be a factor depending on the natural frequency of the structure as constructed by comparison with the natural frequency and amplitude of any combustion process occurring inside the combustion chamber 75.

Figure 20:
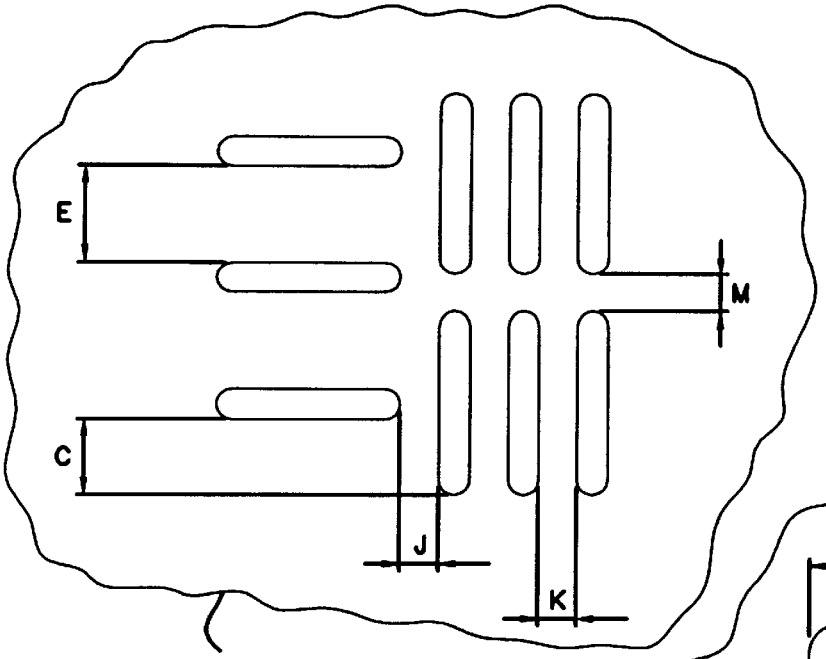
FIGS. 20 and 21 are each a detail view of the spacing of part of the arrangement of ports on the inlet plate of FIGS. 10 and 11, respectively.
Figure 21:
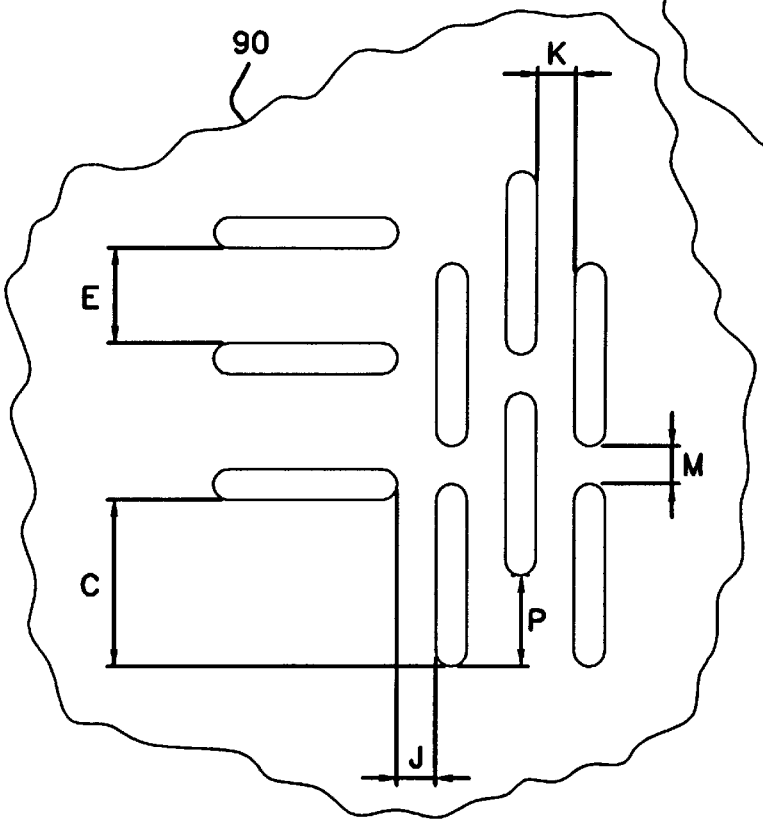
Figure 22:
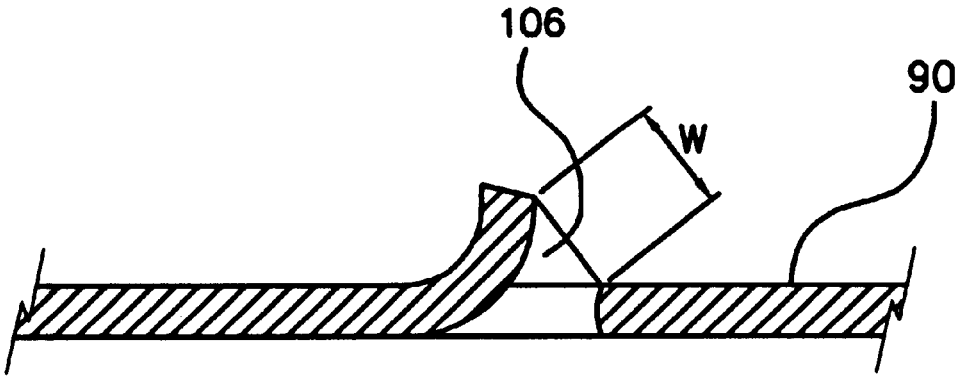
FIG. 22 is a cross-section of an embodiment of a port in an air inlet according to the invention.

FIGS. 19–21 show slot and inter-port spacing dimensions adopted in the embodiments depicted in FIGS. 4–18 generally, FIGS. 20 and 21 particularly referring to FIGS. 10 and 11. The dimensions of the ports are equal and have a length L of 6 mm and a width W of 0.5 mm. The ends of each slot are semicircular but more squarely ended slots are also suitable. The manufacturing process can influence the actual plan view shape of the slot. However, metal blanking such large numbers of holes can be difficult as regards maintaining good condition of such small punches if the corner radii are not rounded. The photochemical machining process of manufacture of plates 90 with slots 104 is adapted to also produce radiused cornered slots.

The discussion has so far assumed ports 102 that are either circular 103 or slot shaped 104. Of course, the invention is not restricted to such shapes. Slots 104 may, in fact, be formed as lines which can be curved or wavy. The quenching distance of such non straight lines is as we have defined and is independent of length L.

As one example, the inlet plate 90 having the dimensions and spacing of slots 104 as indicated above and the pattern shown in FIG. 10, during one testing procedure, allowed passage of fumes of spilled gasoline through the inlet plate 90 where they ignited inside the combustion chamber 75 and burned until vapors formed by 1 U.S. gallon were consumed. This was done without the outside surface temperature of the inlet plate 90 increasing at any point such as to ignite fumes which had not yet passed through the inlet plate. The test concluded when no more gasoline vapor remained to be consumed after more than one hour of continuous burning on the plate 90.

The interport spacing illustrated in FIGS. 20 and 21 performs the required confinement function in the previously described situation. The dimensions indicated in FIGS. 20 and 21 were as follows: C=4.5 mm; E=3.7 mm; J=1.85 mm; K=1.6 mm; M=1.4 mm and P=3.7 mm.

We found that interport spacing distances of 1.1 mm, 1.6 mm and 2.6 mm each gave satisfactory results. Our experiments led us to believe that interport spacings greater than 2.6 mm would be equally successful. However, close interport distances are preferred because the perforated area expressed as a percentage of the total area of an air inlet plate 90 is greater for closer interport distances, for example, with the slot dimensions already given of 0.5 mm wide by 6 mm long perforated area percentages are as follows:

| Interport Distance, mm | 1 | 2 | 3 | 4 |
|---|---|---|---|---|
| Perforated Area % | 29 | 15.5 | 9.8 | 6.9 |

We found interport spacings of 0.5 mm having slot dimensions 0.5 mm×6 mm to the FIG. 4 pattern in 0.5 mm thickness plates 90 are applicable to many situations. However, we prefer about 1 mm to further increase versatility.

Figure 14:
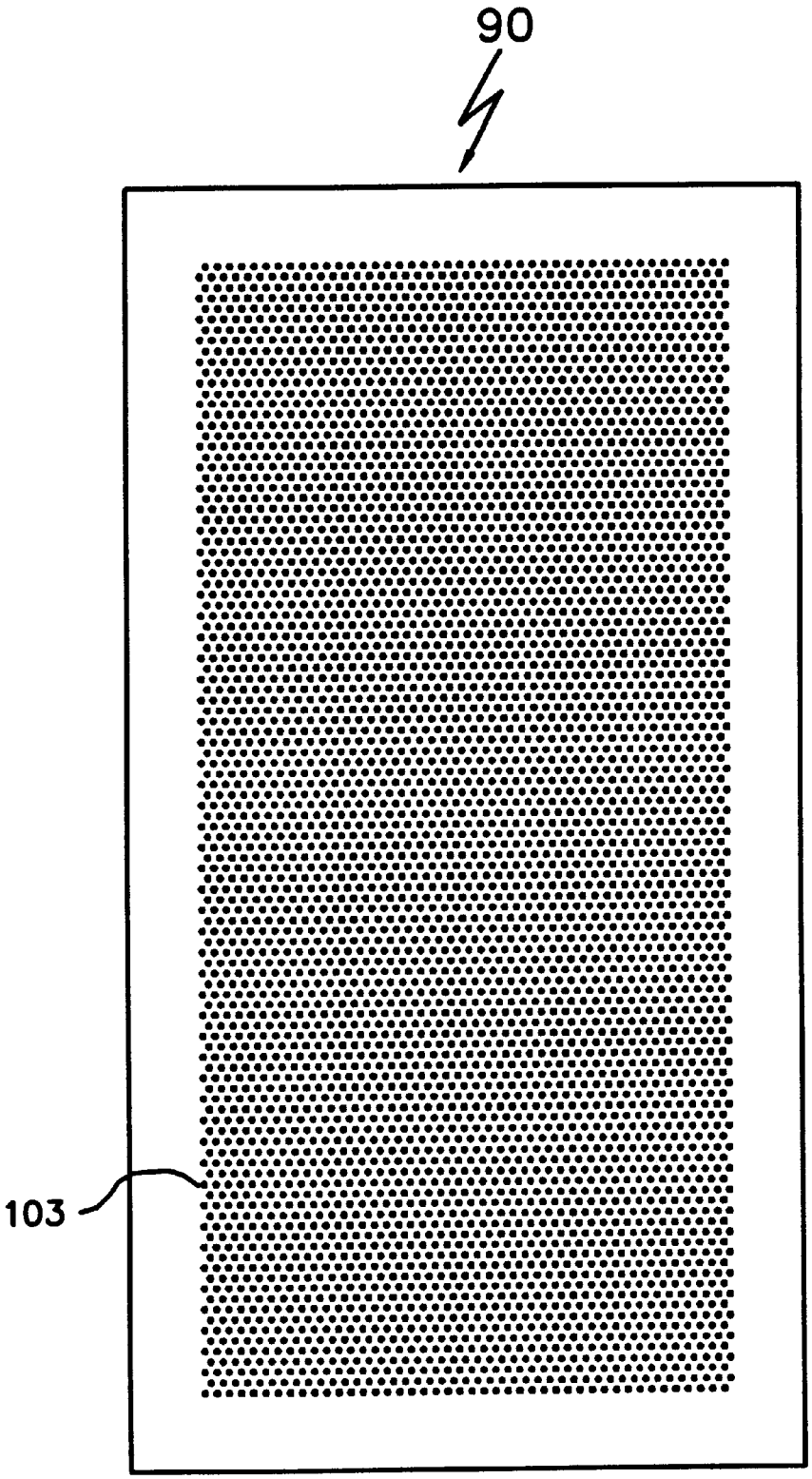
Figure 15:
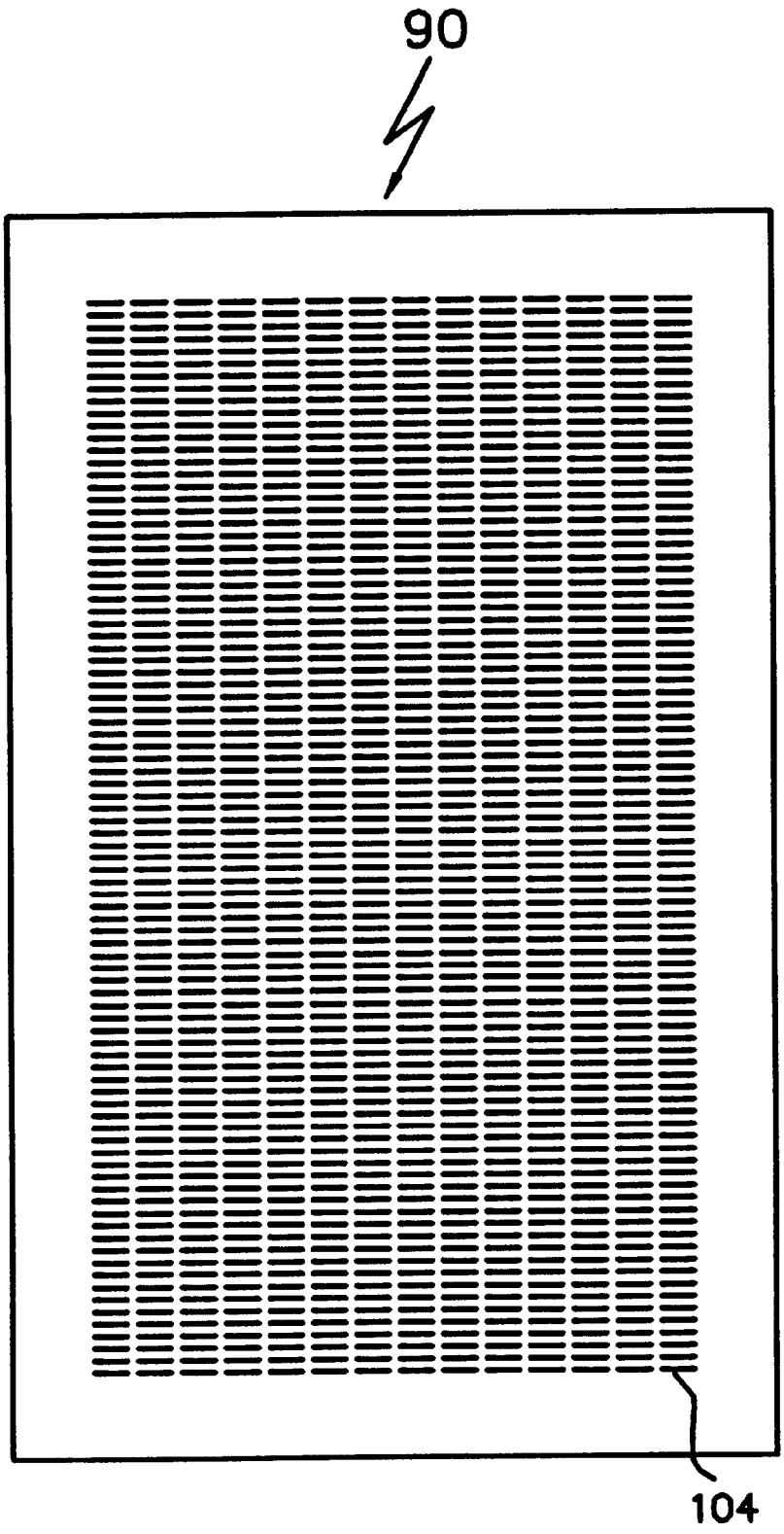

We prefer an interport spacing of at least about 1 mm and preferably at least about 1.5 mm for the air inlet shown in FIG. 14.

Figure 23:
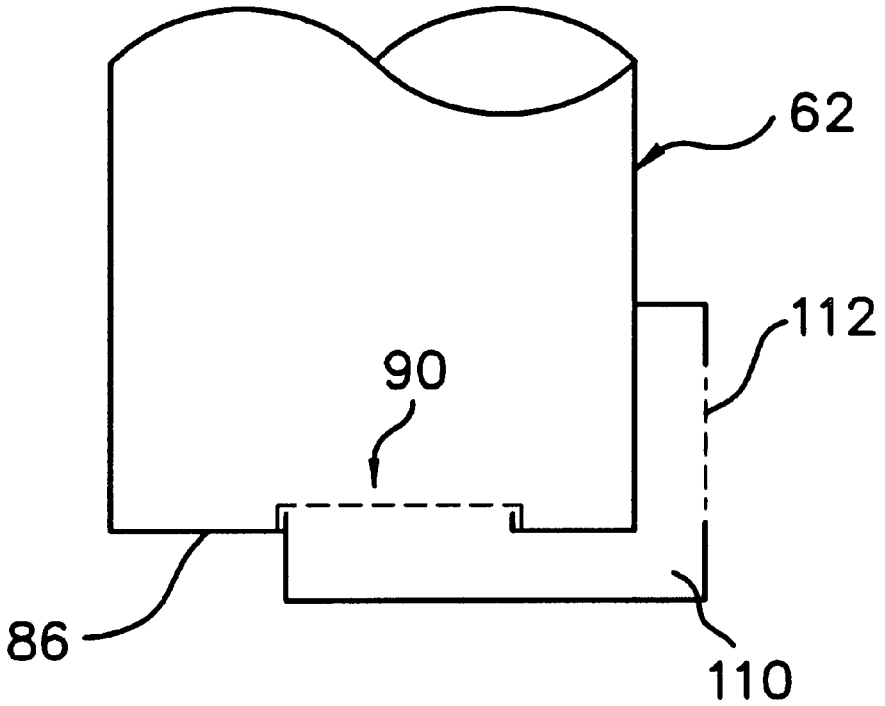
FIG. 23 is a schematic cross-section of a water heater having a ported inlet connected to a remotely positioned clean-in-place lint filter, according to the invention.

Increasing our plate thickness to about 1 mm permits a marginally greater quenching distance, about 0.7 mm to be effective. Reducing our plate thickness 0.2 to 0.3 mm is undesirable for reasons of reduced damage resistance but nevertheless is workable so long as the quenching distance is reduced to about 0.4 mm. FIG. 23 depicts schematically an outline of a lower portion of a water heater 62 having an air inlet leading to a combustion chamber 75 including a plate 90 of the type or similar to those depicted in FIGS. 4–18. Because of the small size of the ports 102 in plate 90 they could, in certain circumstances, be prone to block up or become clogged with lint or other foreign materials. Furthermore, being at a relatively inaccessible part of a water heater 62, an accumulation of lint might not be noticed since water heaters in general are usually not serviced regularly.

Accordingly, it can be advantageous to provide an accessible, more noticeable lint filter 112 as now described. The inlet plate 90 is connected to an air entry duct 110 which turns at right angles and extends substantially horizontally to the front of a water heater 62 whereupon it again turns at right angles to extend upwardly to terminate any convenient distance above the floor level, about 60 cm to 100 cm or higher being suitable. Higher levels are preferred because generally airborne lint levels decrease with increasing height above floor level. The air entry duct 110 is nominally gas-tight (this term is amplified below) where it is terminated by the inlet plate 90 at one end portion and by a non-removable lint filter 112 facing the front of the heater 62 at an accessible height above floor level.

The lint filter 112 has many accessible small holes which can be circular, slotted or other shapes, with no hole individually substantially larger in dimensions than the quenching distance as above defined of the ports 102 or 104 chosen in the particular air inlet plate 90 adopted. The total open area must at least exceed the total open area of the air inlet plate 90 so as not to add greater restriction to air flow than the inlet plate 90 itself. To this end, it is better if the lint filtering holes have in total a very much greater area for air flow than the ports 102 or 104 in the air inlet plate 90 so that the total resistance to flow is minimized and, furthermore, the available area for lint interception is maximized. Most of the lint filtering holes are positioned ideally as far above the floor as possible to face the front of the heater so as to be accessible for cleaning routinely, ideally with a vacuum cleaner. A safety maintenance notice to occupiers of premises in which such water heaters or other gas consuming appliances benefiting from equivalent protection are installed, is ideally fixed adjacent to the face of the lint filter 112 to remind of the need for regular intervention to remove any apparent lint build-up.

The duct 110 was above described as nominally gas tight—it is not required to be fully gas tightly sealed, so long as its connection to the combustion chamber wall 86 meets the criterion of having no gap or crack exceeding the defined quenching distance for any feasible extraneous fume species (entering the air inlet) which is desired to be confined, if ignited, within the combustion chamber 75.

Figure 29:
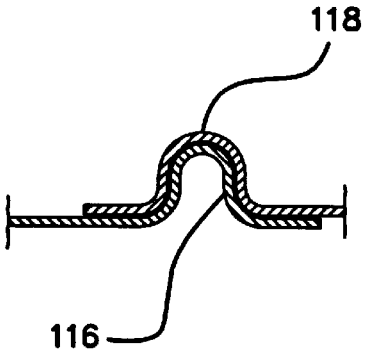

FIG. 29 shows in schematic cross-section one suitable connection between an air inlet plate 90 and lower wall 86 of a combustion chamber 75. We observed that prolonged combustion of a relatively large quantity of extraneous fumes on the inside surface of the plate 90 (e.g. such as would vaporize from the spill of one US gallon of gasoline), leads to intermittent heating to incandescence at various points around the inside surfaces of various plates 90 tested. We observed as expected that heating to maximum incandescence of the plates 90 particularly correlates to extraneous fumes to air ratios close to the stoichiometric value for the particular extraneous fumes.

The air inlet plate 90 in such circumstances acts like some types of perforated metal gas burners which function at red heat such as for broiling or grilling but, unlike any such burner of that type, the air inlet plate in this invention must be able to provide reliable confinement operation despite an uncontrollable and uncontrolled spectrum of flow rates of flammable fumes relative concentration in a mixture of air and the flammable fumes. With our air inlet plate 90, any pre-mixing of the air and extraneous fumes is incidental and random, unlike the uniform pre-mixing of air and fuel in a normally designed gas burner.

Figure 24:
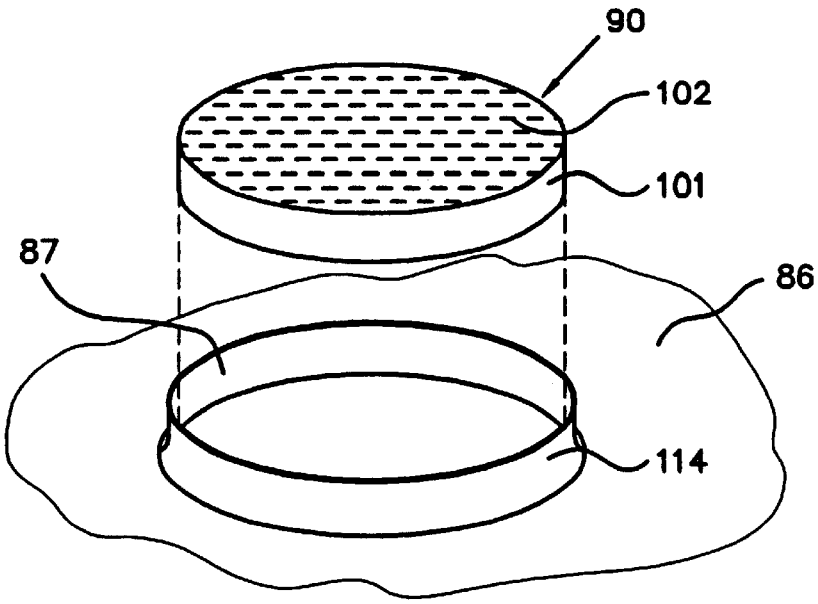
FIGS. 24 and 25 illustrate alternative forms of attachments according to the invention of two shapes of inlet to a wall of a combustion chamber of a water heater.
Figure 25:
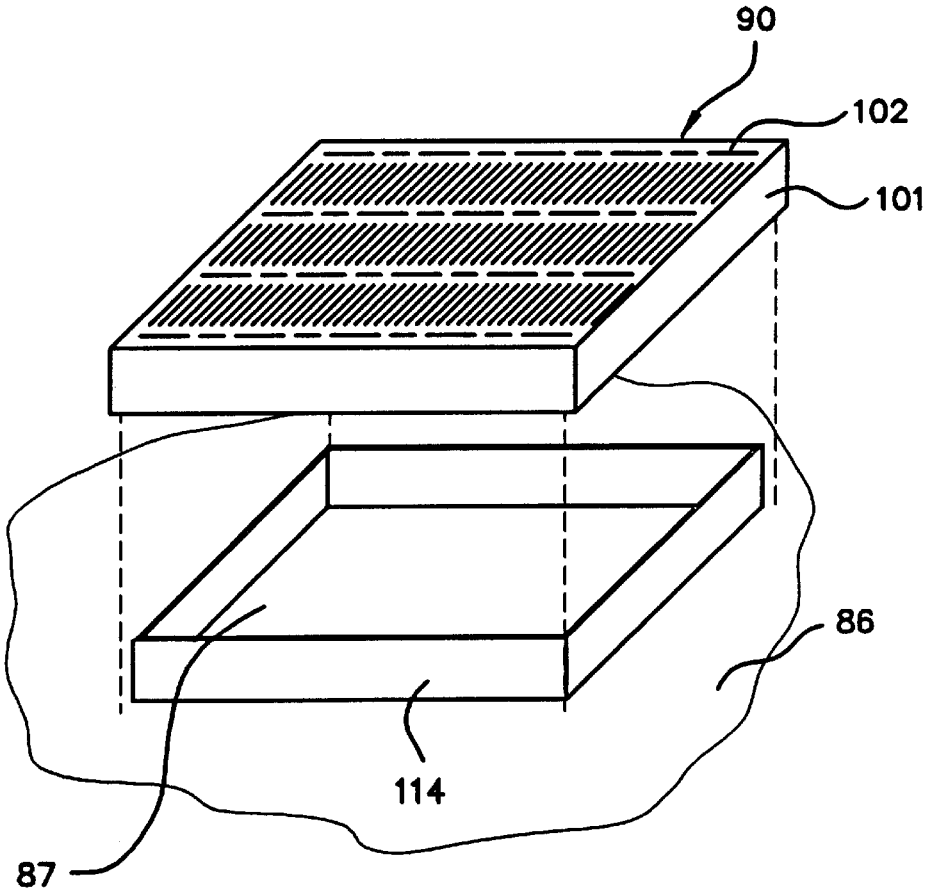
Figure 26:
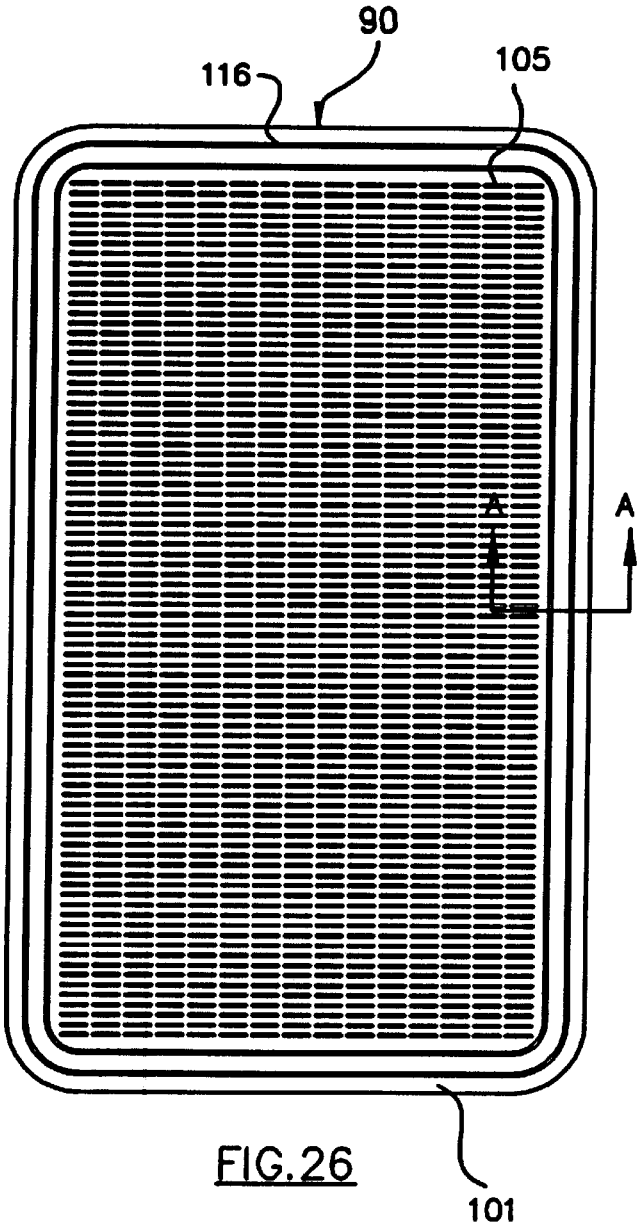
FIGS. 26–29 are views respectively: a plan; cross-section; edge detail and partial cross section; and attachment detail cross section; of one version of an air inlet plate and its attachment to a combustion chamber.
Figure 27:
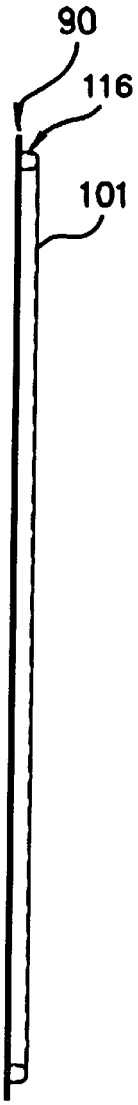
Figure 28:
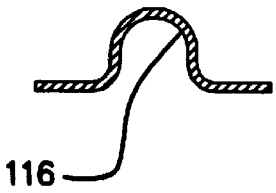

The form of construction shown in FIGS. 24 and 25 shows two variants in which, separated from its assembled position, an inlet plate 90 which has an unperforated border 101 is assembled downwardly (as indicated by the dashed lines) in highly thermally conductive contact with a combustion chamber opening 87 formed, such as by piercing and extruding, a flanged border 114 defining an inwardly opening hole 87 into the combustion chamber 75. The compressive contact can be achieved by metal to metal frictional contact involving mating flanges 114 and 101 or may include some form of gasket between the contacting faces of those flanges. FIG. 24 shows a circular plate 90 which fits tightly inside the flanged border 114 around the extruded hole 87 in the combustion chamber wall 86. FIG. 25 shows a rectangular plate 90 which fits tightly on the outside of the flanged border 114 around the mating hole 87 in the combustion chamber wall 86. It is optional whether either the circular or the four-sided variant mates inside or outside the flanged border.

FIGS. 26 to 29 illustrate a rectangular inlet plate 90 comprising a perforated central portion 105 bounded by a non-perforated portion 101 which is formed to include a peripheral channel 116. The peripheral channel 116 is shaped to enable the inlet plate 90 tightly engage, or otherwise to snap into a mating connection 118 (FIG. 29) formed around an opening 87 in the base 86 of the combustion chamber 75. The combustion chamber 75 with inlet plate 90 fitted is enclosed at the top by a mating connection to or adjacent the outside periphery of the curved base of the tank 66 of a water heater 62 and so forms a closed combustion chamber 75. Those potential sources of ignition of extraneous fumes forming part of water heater 62, namely the burners 73 and 74, are enclosed by location in the combustion chamber 75. The combustion chamber walls 79 support the mass of a water tank 66. The peripheral channel 116 in the inlet plate 90 and the mating peripheral groove 118 surrounding the opening 87 in the base of the combustion chamber 75 frictionally engage to nominally sealed standard as explained above. The groove 118 can function as a dam to exclude any condensed moisture accumulating on the base 86 of the combustion chamber 75 from spreading across the perforated areas 105 of the plate 90.

Figure 30:
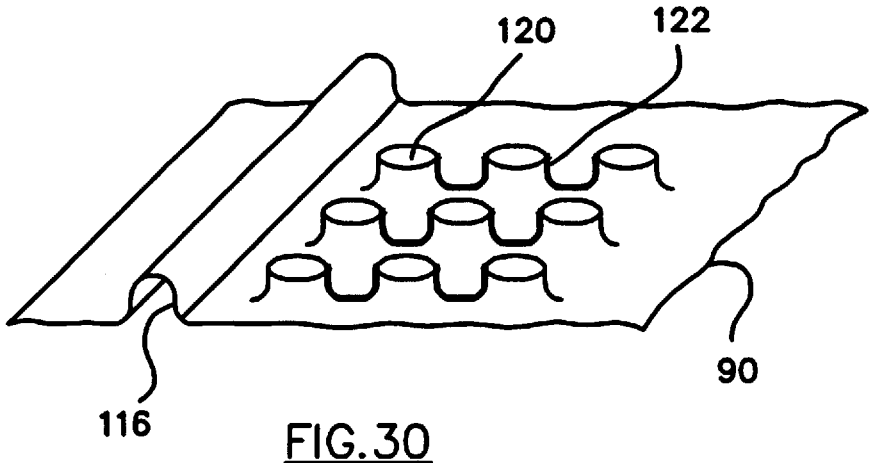
FIG. 30 is a perspective view of a version of an embodiment of an air inlet plate.
Figure 31:
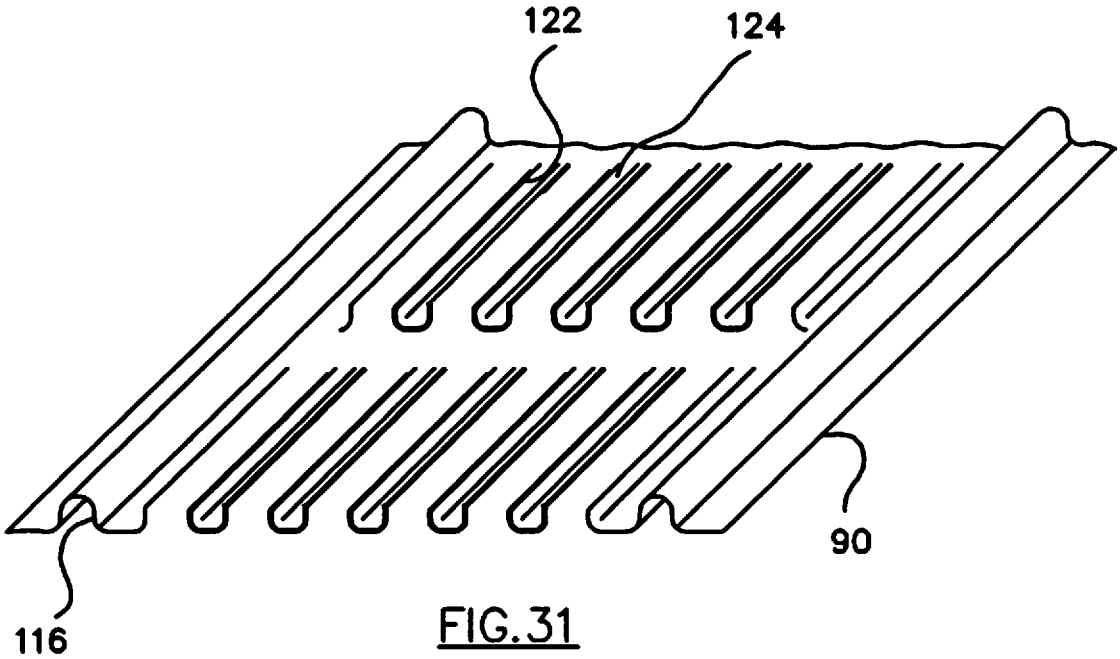
FIG. 31 is a perspective view of a version of another embodiment of an air inlet plate.
Figure 32:
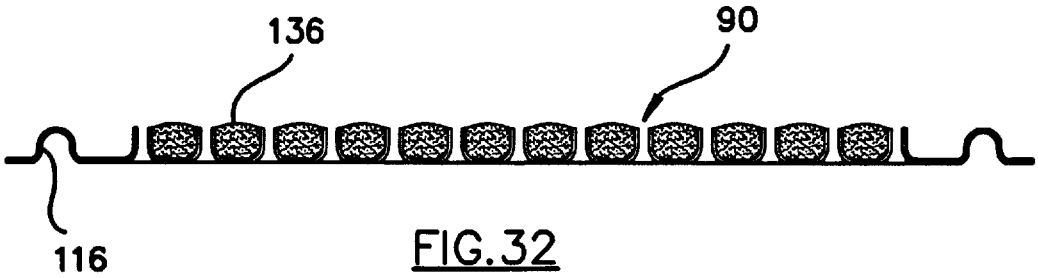
FIG. 32 is a cross-sectional view of the air inlet plate shown in FIG. 31.

FIGS. 30–32 schematically show alternative forms of profiled ports on a portion of air inlet plate. The ports (slots in FIG. 31) can provide a more streamlined flow profile through them and can provide a convenient "valley" matrix in which to position viscous form(s) of intumescent swellable coating 136. The application of intumescent swellable coating 136 to this invention will be described subsequently in relation to FIGS. 39–41.

In relation to all the forms of inlet plate 90 so far illustrated, it is of concern that an initial ignition of flammable extraneous fumes inside the combustion chamber 75 as a sudden energetic detonation be minimized. Otherwise, there might theoretically be a risk of blowing a flame front back through the ports 102, 104 of the inlet plate 90. Forms of water heater 62 shown schematically in FIGS. 33–35 particularly address this concern.

Figure 33:
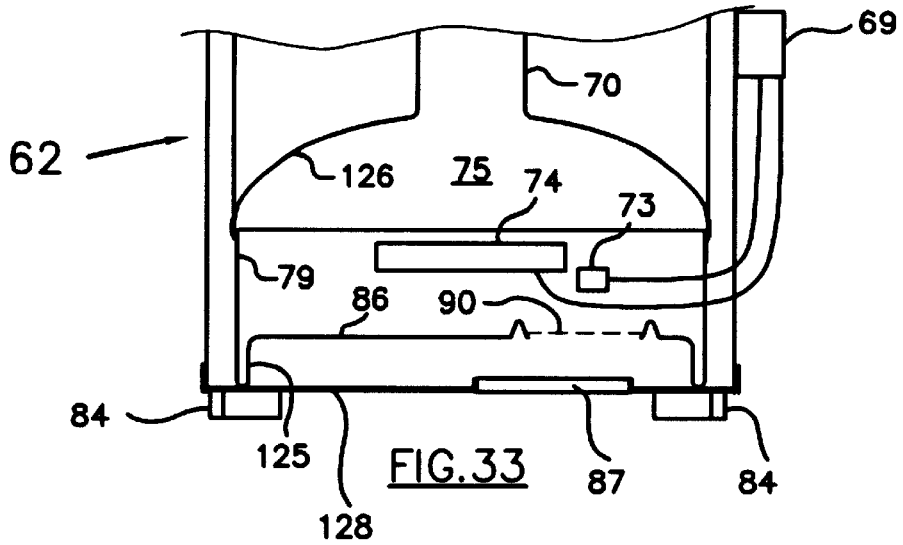
FIGS. 33–35 are schematic cross-section views of three embodiments of water heaters showing relative positions of air inlet plates to other components including the combustion chamber walls.

In FIG. 33, the entire base 86 of the combustion chamber is positioned at the top of a drawn wall 125 of the combustion chamber 75, the lowest perimeter of the combustion chamber providing a support which rests on a support pan 128 which in turn is supported above floor level on feet 84. The base 86 of the combustion chamber 75 and the inlet plate 90 are co-planar or approximately so and, by virtue of the described structure, position the inlet plate 90 as close as possible to the burners 73 and 74.

Figure 34:
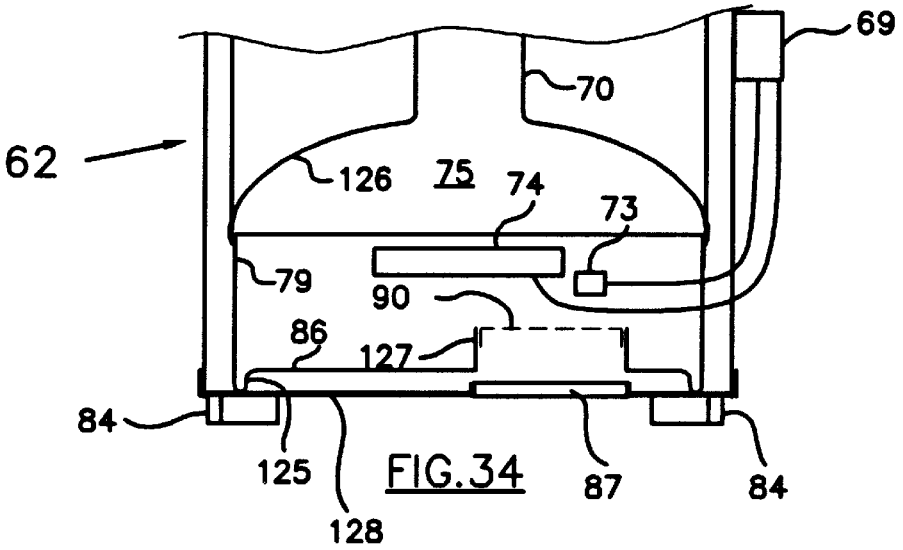
Figure 35:
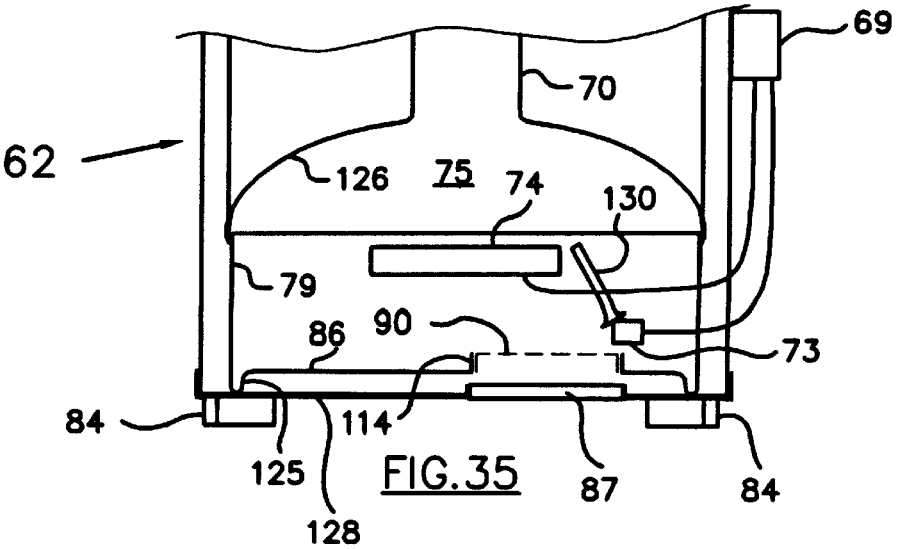

In FIG. 34, the main burner 74 is conventionally positioned but the pilot burner 73 is positioned immediately above the inlet plate 90 upper surface. This provides opportunity for a more immediate ignition of extraneous fumes entering the combustion chamber 75 through the inlet plate ports and, thereby, substantially increases the probability that only a very small quantity of extraneous fumes would be in the combustion chamber 75 when ignition first occurs. Such a small volume of extraneous fumes, if ignited, is likely to burn with a relatively low energy of initial ignition prior to establishment of a continuous flame upon the upper surface of the inlet plate 90. In order to ensure reliable ignition of the main burner 74 of a water heater during normal operation, when the pilot burner is positioned particularly closely adjacent to the inlet plate as shown in FIG. 35, a flash tube 130 is provided leading from the pilot burner 73 up to the level of emission of the gaseous fuel from the main burner 74 to facilitate the frequent re-ignition of the main burner 74 from the pilot burner 73 during normal use of a water heater 62.

In order to avoid the development of high sound pressures various predeterminable design parameters can be chosen or operating conditions influenced to minimize undesirable effects. If a particular design is found prone to excessive sound level generation, then changes to that design to lessen the tendency include the reduction of temperature of the plate 90, changes to the length of the flue pipe 70, the spacing of ports 104 and the thickness of the air inlet plate 90, embossments to stiffen the air inlet plate 90 and gasket or compressible packing placement between the lower wall of the combustion chamber lower wall 86 and a parallel lower wall of the support pan 128, as will be described in relation to FIG. 52 below.

Figure 36:
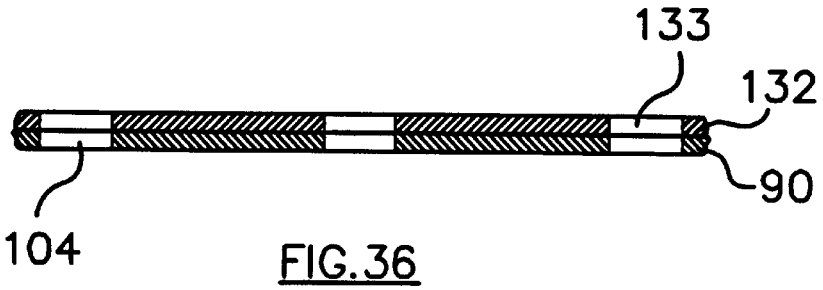
FIG. 36 is a detail of one embodiment of an inlet in cross section.
Figure 37:
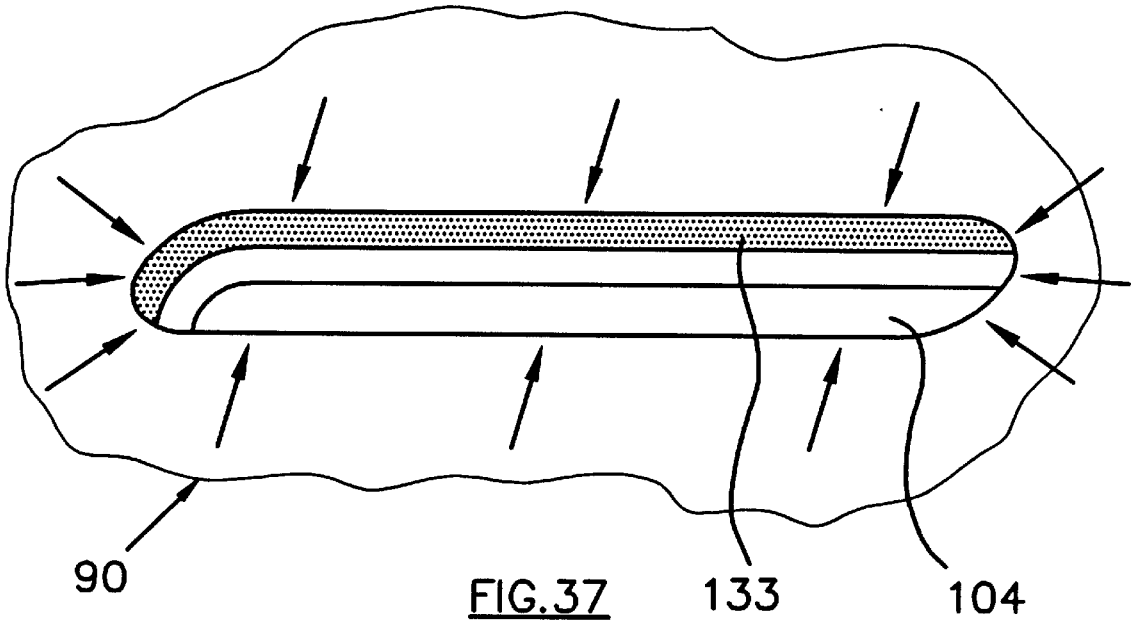
FIG. 37 is a perspective view of one port in the inlet as shown in FIG. 36.
Figure 38:
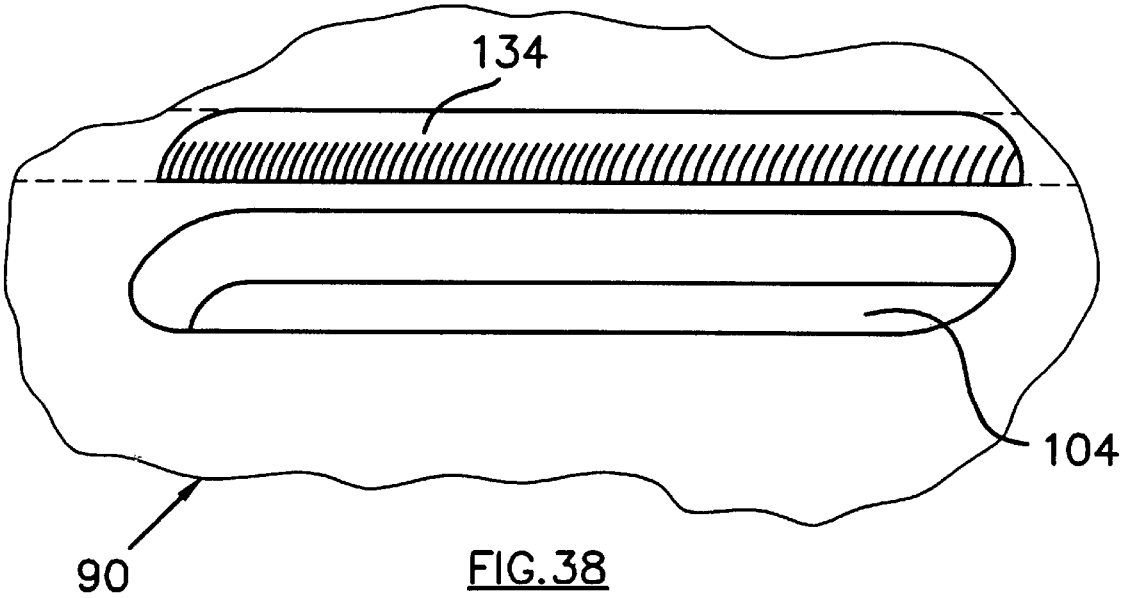
FIG. 38 is a perspective view of one port of an inlet with an adjacent bead of solder.

FIGS. 36–38 show arrangements to terminate prolonged combustion on a plate 90 for use in those instances in which it is desirable to extinguish that combustion quickly rather than allow it to draw remaining spilled extraneous fumes to consume them by combustion. FIG. 36 depicts a portion of air inlet plate 90 covered by a thin layer 132 of solder which has matching ports 133 to those in the plate 90. When this layer 132 is heated by extraneous fumes burning on the inside of the combustion chamber 75, the heated solder layer 132 liquefies and spreads to block or tend to block the adjacent slot or slots 104. The plate 90 may be also formed with surfaces converging toward each slot 104, allowing the liquefied solder to more readily block each slot.

Because of the small dimensions of the slots 104 the solder bridges them by capillary action by virtue of its surface tension, so occluding them fully or, at least partially. Partial occlusion is desirable even if full occlusion is not achieved since any reduction of port cross-section area under the circumstances tends to destabilize the flames, thereby increasing the probability of extinguishing them quickly. To further assist the flow of solder 132 the surface of the plate 90 can be pre-treated with a fluxing agent such as widely known in soldering techniques.

At times when the inlet plate 90 admits a near stoichiometric mixture of air and extraneous fumes, particularly over a prolonged period, then the temperature of the inlet plate 90 caused by combustion of that mixture inevitably increases. We discovered that upon a sufficient increase in the temperature of the inlet, a harmonic resonant sound may be generated by various complex thermal effects including that known as the Rijke tube effect. In certain embodiments of the invention, we discovered that these effects cause energetic sound waves to be produced in the combustion chamber 75, most noticeable when combusting at around 100% aeration. This can build to sound at a high level at a frequency or frequencies, usually in a frequency range about 80–250 Hz during operation, continuing until such time as the gas to air mixture changes sufficiently away from the stoichiometric value or burning conditions otherwise change.

Figure 39:
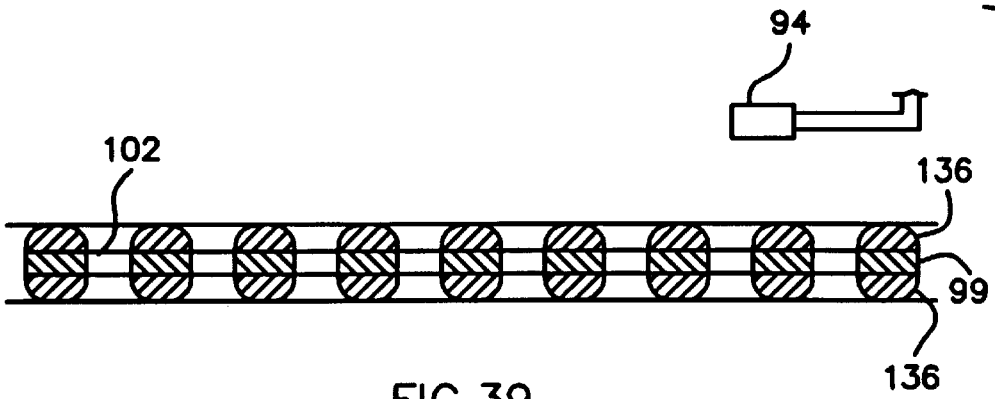
FIG. 39 is a cross section of an air inlet plate coated with an intumescent coating.
Figure 40:
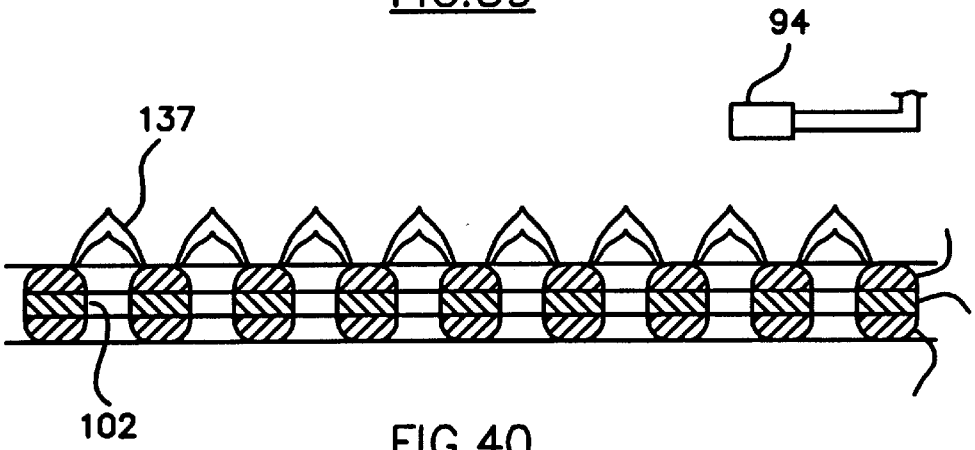
FIG. 40 is a cross section identical with FIG. 39 with the addition of combustion of extraneous fumes on one surface.
Figure 41:
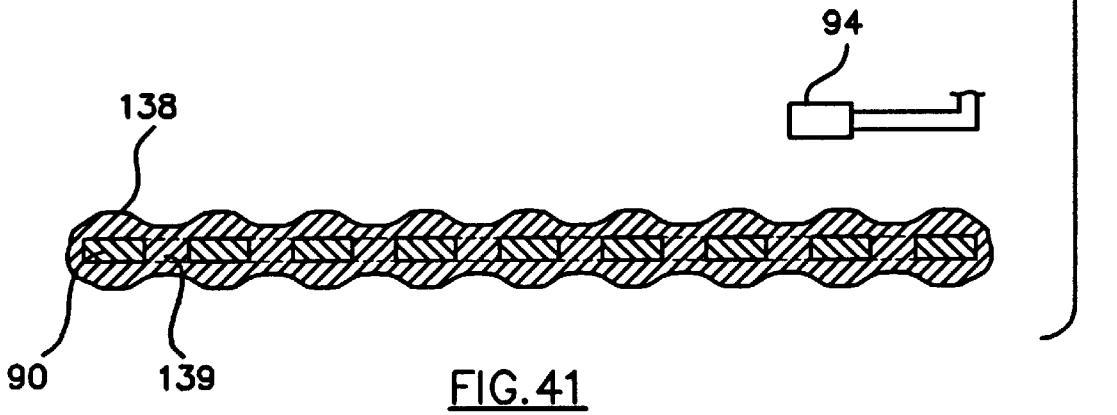
FIG. 41 is a cross section showing the aftermath of the combustion shown in FIG. 40.

With reference to FIGS. 39–41 a portion of inlet plate 90 is shown in cross-section having a solid matrix separated by ports 102. Closely positioned above the upper surface of the inlet plate 90 is a sensor 94 applicable to all variants of the present invention, being adapted to shut off the gas supply to the main burner 74 and pilot burner 73 if a flame becomes established on the upper surface of the inlet plate 90. In the inlet plate 90 shown in FIGS. 39–41 an intumescent ablative coating 136 has been applied to cover the solid matrix of the inlet plate, leaving (in FIG. 39) the ports 102 unobstructed. As shown in FIG. 40, if extraneous fumes enter through the ports 90, and form a combustible mixture in the combustion chamber 75, the main burner 74 or pilot burner 73 (as shown in FIG. 1, positioned typically 5–10 cm above the inlet plate) establishes ignition of the extraneous fumes as flames 137 on the upper surface of the inlet plate 90. The sensor 94 then reacts quickly to cause shut-off of gas to the main and pilot burners 74 and 73.

Combustion on the plate 90 most likely continues and the flames 137 cause the temperature of the inlet plate 90 as a whole to rise and, at a temperature appropriate to the intumescent coating selected, the coating 136 softens and reacts, to swell to numerous times its original volume (FIG. 41), thereby occluding the ports 102 of the inlet plate 90. Such occlusion has the effect of excluding the extraneous fumes and air so combustion on the inlet plate quickly ceases. No further possibility then exists of igniting extraneous fumes inside or outside the combustion chamber 75 without replacing the plate 90. Suitable intumescent/ablative coatings include "Firetex" "M70/71" (basecoat/top seal intumescent fire retardant coating, manufactured by Fyreguard); and "Firedam 2000" intumescent coating supplied by 3M. A coating thickness of about 200 $\mu$m on a Schwank tile or plate of the types shown in FIGS. 30, 31 and 32, is suitable and a lesser thickness about 100 $\mu$m, is more appropriate for a flat or substantially flat perforated metal sheet type inlet plate 90 as illustrated in FIGS. 39–41.

Figure 42:
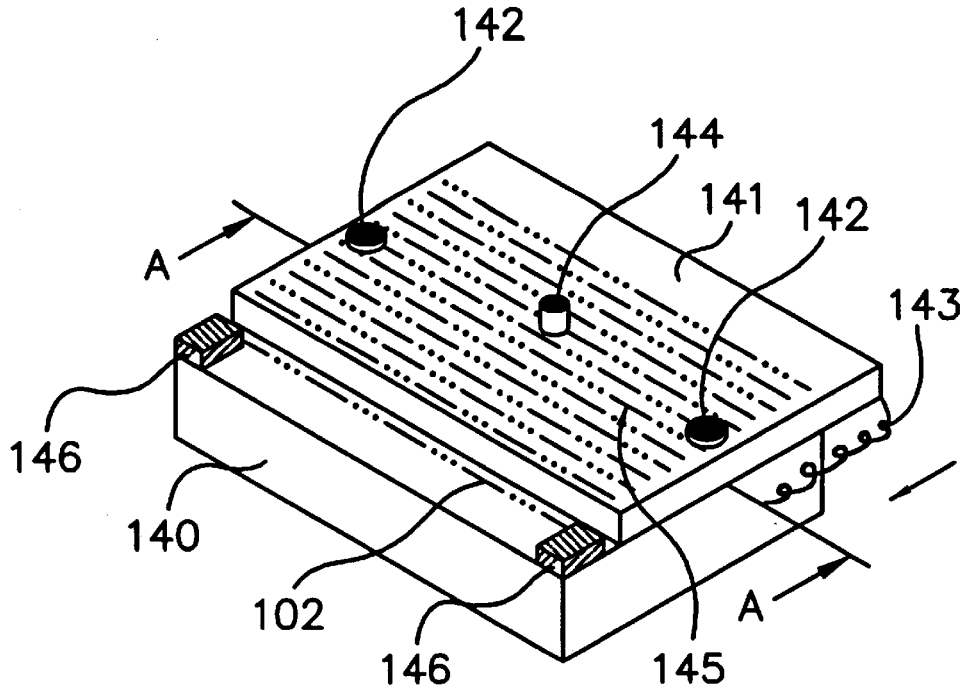
FIG. 42 is a perspective schematic view of an inlet plate with a sliding mechanism to occlude ports in an inlet plate.
Figure 43:
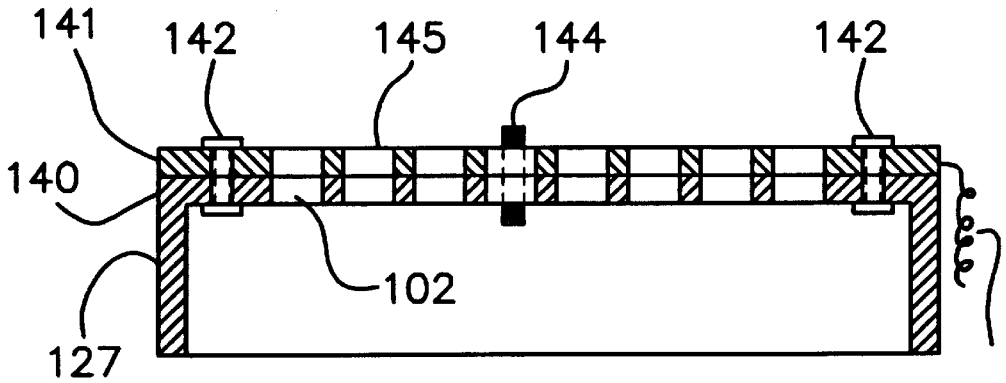
FIG. 43 is a cross section along the line A—A through the arrangement of FIG. 42 with ports aligned.

FIGS. 42–47 show a series of devices in which a prolonged combustion incident inside a combustion chamber 75 can be more quickly extinguished. Mounted to the inlet plate 140 is a sliding plate 141 which has ports 102 of corresponding size, patterns and orientation to the ports 102 in the fixed inlet plate 140. FIG. 43 shows alignment of the ports 102 to provide a through passage for air and extraneous fumes to pass. The sliding plate 141 is biased to the position shown in FIG. 43 by one or more spring(s) 143, which as depicted in FIG. 42 can be tension spring(s) 143. The sliding plate 141 is locked into one location by a solder or thermoplastics pin 144, tension being applied to the spring 143. The sliding plate 141 can move by sliding relative to the fixed plate 140, guided in a restricted path by sealed rivets 142 which are secured leak tightly to the fixed plate 140 and which are a sliding fit into a pair of guide slots in the sliding plate 141.

In the event that extraneous fumes pass through the fixed inlet plate 140 and sliding plate 141, the extraneous fumes with an appropriate air mixture would be ignited by either the pilot 73 or main burner 74 of the water heater 62. Following a short period of burning, the sliding plate 141 would heat to a temperature sufficient to melt the solder or thermoplastics pin 144, whereupon the force applied by the spring 143 would move the sliding plate 141 in the direction of the arrow. The guide slot(s) can only be long enough to allow unperforated parts of sliding plate 141 to align with the ports 102 in fixed plate 140 or, as an alternative, the slots 102 can be longer but two stops 146 can be provided to limit the travel of the sliding plate 141 over the fixed plate 140 and, either way, as shown in FIG. 44, result in the closure of all the ports 102 thus extinguishing any further combustion.

To reopen the combustion chamber 75 after an episode of ignition of extraneous fumes, the sliding plate 141 is held against the bias provided by the spring 143 while placing a replacement solder or thermoplastics pin 144 into the aligned holes provided for the purpose through the plates 140, 141. The air inlet 90 would then be functional again to allow normal combustion air flow but to cut off air and extraneous fumes if needed.

Figure 44:
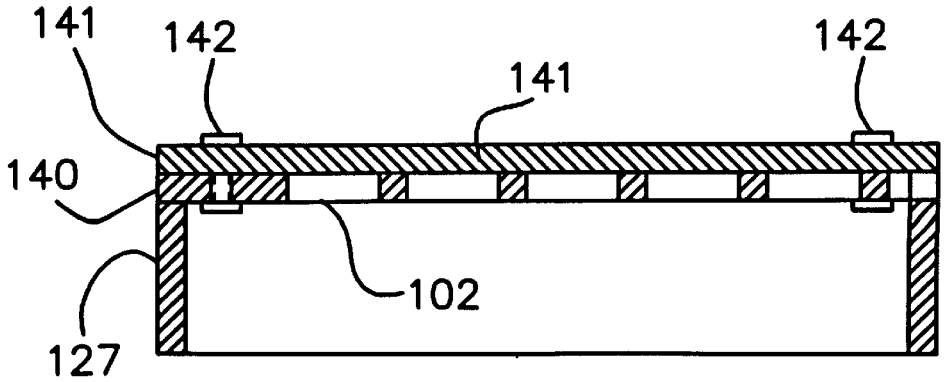
FIG. 44 is the same cross section of FIG. 42 when the ports are occluded.

In a suggested variation of the inlet cut-off of FIGS. 42–44, the solder or thermoplastics pin can be replaced by a thin layer of solder between the plates. This layer of solder creates a laminate of the two metal plates sandwiching the solder, being also provided with ports aligned initially through all three layers of the laminate.

Connection of the sliding plate to a spring could be provided as shown in FIG. 42 or equivalent. This variation has advantages including that the solder facilitates relative sliding between the plates once the solder liquefies due to heat input. Moreover, its ability to exclude extraneous fumes from finding a leakage access between the plates is an advantage. The sliding plates shown in FIGS. 42–44 could be susceptible to seizure in their open position in the likely event of only extremely rarely being activated and, to move, any friction between them must be overcome. This suggested variation having a laminate of solder between slidable plates will not seize and once the solder liquefies, will slide freely. As FIG. 42 shows, both holes and slots with quenching distances and inter-port spacings as previously specified may be combined in a single air inlet plate 141.

Figure 45:
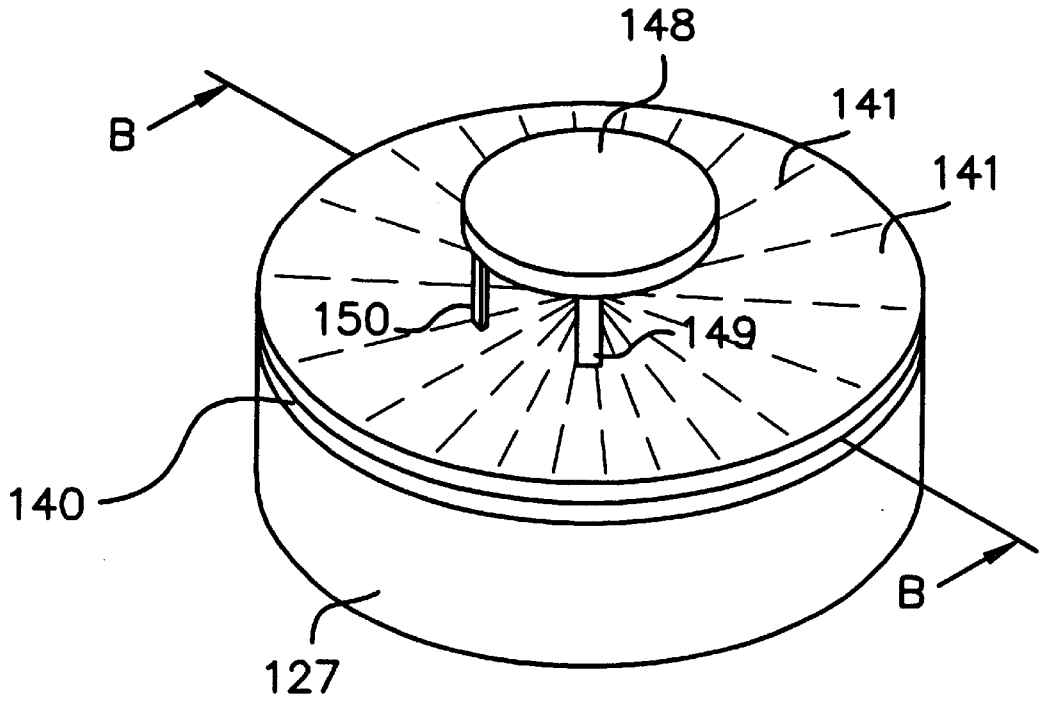
FIG. 45 is a perspective schematic view of an inlet plate with a rotary mechanism to occlude ports in an inlet plate.
Figure 46:
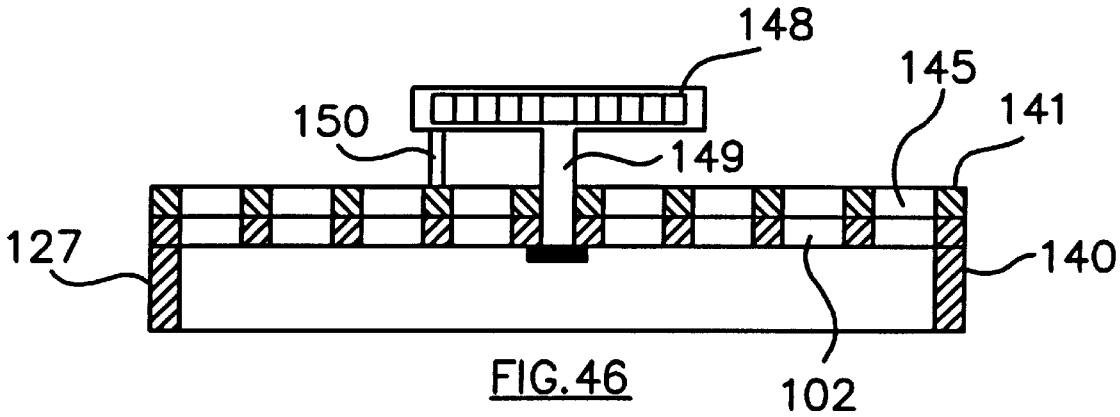
FIG. 46 is a cross section along the line B—B through the arrangement of FIG. 45 with ports aligned.
Figure 47:
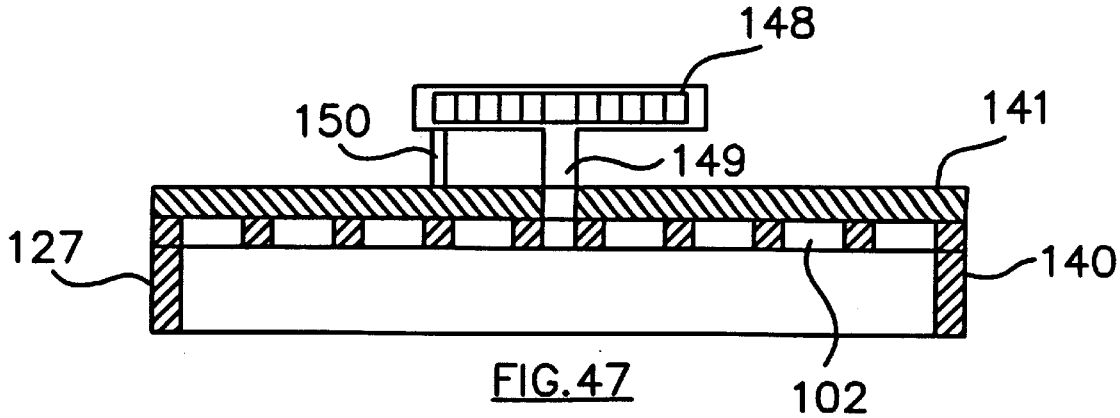
FIG. 47 is the same cross section of FIG. 45 when the ports are occluded.

FIGS. 45 to 47 show a similar occluding mechanism to those of FIG. 42 to FIG. 44, although in this case the cut-off of air entry is by relative rotation between the plates rather than linear movement.

FIG. 45 shows a circular inlet plate like that illustrated in FIG. 2. Overlying the fixed plate 140 is a rotary plate 141 with ports 145 aligning with ports 102 in fixed plate during normal use, as shown in the cross section of FIG. 46. Secured to the fixed plate 140 is one end of a spindle 149, which carries, at its other end, one end of a bimetallic torsion spring 148 which in turn, at its other end, is attached to the rotary plate, by a pin 150. Upon heating of the bimetallic torsion spring 148 by the burning of extraneous fumes at the ports 145 the bimetallic torsion spring 148 rotates the rotating plate 141 relative to the fixed plate 140. Appropriate stops between the two plates 140, 141, are provided to enable the respective ports 102 and 147 to remain out of mutual alignment, as shown in FIG. 47.

Upon cooling of the bimetallic torsion spring 148, the rotating plate 141 returns to its original position bringing the ports 102, 145 in both plates into alignment again, ready to allow air to pass through to enable combustion and to allow extraneous fumes if present, to pass through.

FIGS. 45 to 47 features can be combined, such as the bimetallic torsion spring 148 being replaced by a coil spring or other spring, and the plates 140, 141 being held in register (to allow air to pass) by a solder or thermoplastics plug 144 or a layer of solder between them, in each case relying on heat to melt the solder or thermoplastics, so allowing the spring force to rotate the rotating plate 141 relative to the fixed plate 140 to shut off combustion of extraneous fumes in the combustion chamber 75.

Inlet plates of the invention which have ports solely in the shape of slots 104 allow flames burning extraneous fumes inside the combustion chamber 75 to lift further off the air inlet plate 90 and thereby reduce the operating temperature of the air inlet plate 90 as compared to a plate of the same material and thickness having circular holes 102. Therefore, a plate 90 with slots 104 can consume more spilled substance over a longer combustion period, than can a plate 90 with holes 102 having an equivalent quenching distance. Also, slots 104 enable lint passage more readily than circular holes of equivalent quenching distance.

Figure 48:
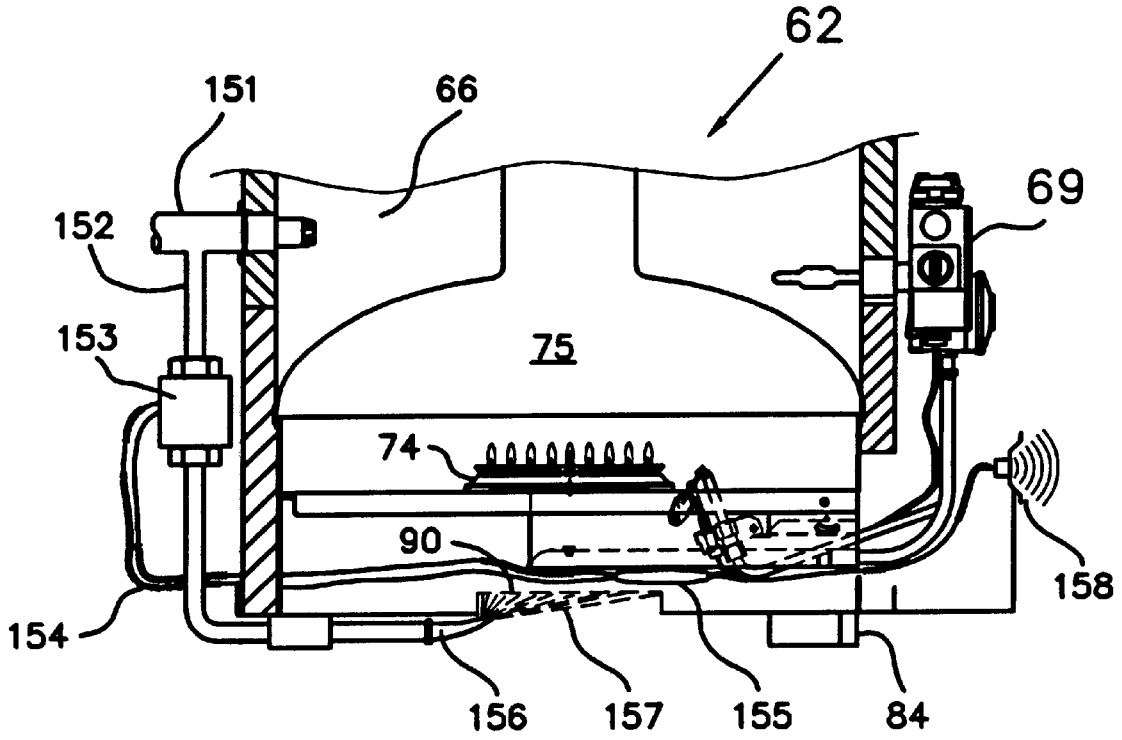
FIG. 48 is a partial cross section of the lower portion of a water heater with a spray nozzle at an air inlet according to the invention and including an audible alarm.
Figure 49A:
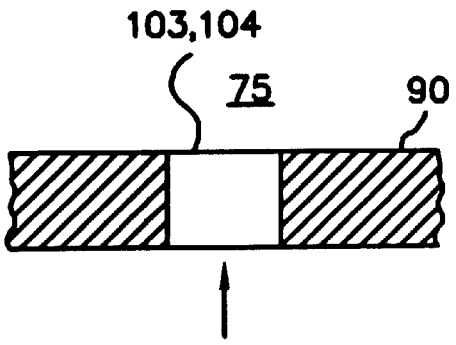
FIGS. 49(*a*) to (*d*) are partial cross-sections of ports in inlet plates.
Figure 49B:
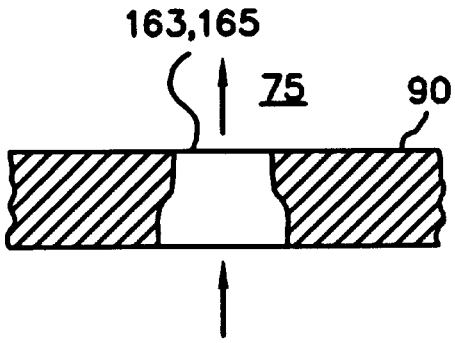
Figure 49C:
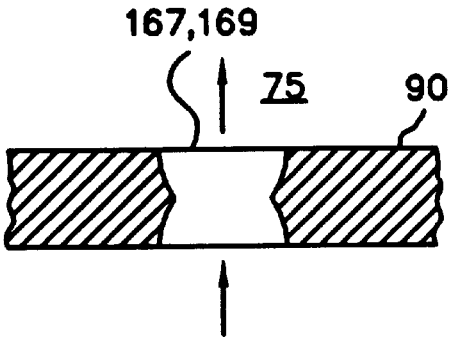
Figure 49D:
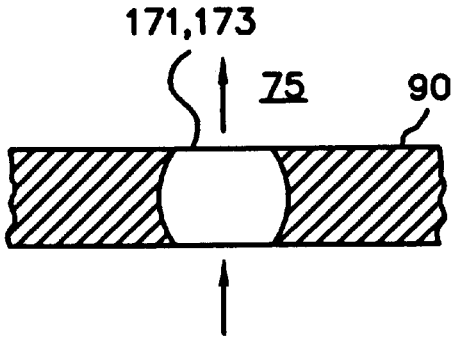

FIG. 48 shows two additional provisions possible to incorporate, so enhancing the likelihood of a safe outcome following a flammable substance spillage incident near a gas water heater having an air inlet 90 according to the invention. Either provision may be included separately or together.

The first provision is an audible alarm 158 which operates in the event of a flame becoming established in the combustion chamber 75 at or adjacent the inside surface of the air inlet plate 90. The alarm 158 can be actuated by a number of energy sources, one being an enclosed metallic bulb 155 containing a volatile substance which expands when heated, the bulb 155 being connected to the alarm by a small bore tube. The tube is sealed by a frangible diaphragm that bursts to vent the volatile substance through a whistle or similar audible device included in the alarm 158.

The second provision is a cooling device including a spray nozzle 156 positioned and aligned to direct a fine spray of water 157 at the perforated area of the air inlet plate 90. The water 157 is sourced from the mains pressurized cold water supplied to the tank through a pipe 151, diverted therefrom by a branch pipe 152 through a valve 153, the outlet of which is connected to the spray nozzle 156. The valve 153 is biased in a normally closed position and is opened to allow passage of water through the valve by lateral admission of a pressurized fluid via a small bore tube 154. The pressurized fluid is sourced from the temperature sensitive element 155 on any such occasion that it is heated by flame arising from combustion of extraneous fumes on the inside surface of the air inlet plate 90. Other flame extinguishing substances such as compressed carbon dioxide may be suitable and can be released using generated heat to similarly open an appropriate escape path.

FIGS. 49(*a*), (*b*) and (*c*) show the possibility of forming the ports 103 and 104 in plates 90 of the invention having not only a parallel sided cross-section, as shown in FIG. 49(*a*), which can be readily formed by any of the processes previously mentioned. Ports 103 and 104 can be used which in cross-section have both convergent and divergent shapes. The photochemical machining process lends itself to forming holes with convergent or divergent shapes as illustrated in FIGS. 49(*b*), (*c*) and (*d*).

FIG. 49(*b*) shows a hole 163 or slot 165 which converges from a larger dimension at the upstream face (i.e. the lower side, as illustrated) of the air inlet plate 90. Air and, if present, extraneous fumes, passes through the tapering hole 163 or tapering slot 165 in a downstream direction indicated by the two vertical arrows into the combustion chamber 75. The hole 163 or slot 165 as illustrated in FIG. 49(*b*) converges in an upstream direction firstly but then terminates with substantially parallel sides.

FIG. 49(*c*) shows a tapered hole 167 or tapered slot 169 which converges to a throat of minimum cross-sectional area between the upstream and downstream faces of the air inlet plate 90 which tends to provide minimum drag for a given limiting dimension of the port 167, 169. By this technique the air inlet plate 90 can provide an optimized combination of maintaining restriction to air flow within workable bounds with ability to confine combustion inside the combustion chamber 75 for as long a time as necessary.

FIG. 49(*d*) shows a tapering hole 171 or tapering slot 173 in which air for combustion passing through the air inlet plate 90 in the direction of the vertical arrows into the combustion chamber 75 first passes through a divergent portion which then converges such that the intersection of the port 171, 173 intersects with the inside (upper) surface of the plate 90 at an angle somewhat less than 90°. The very sharp edged orifice so formed at the inside surface of the air inlet plate 90 is believed to function as a flame lift promoter so that combustion of extraneous fumes occurring near the inside surface of the plate 90 is encouraged to lift flames away from that surface, with the effect of causing the plate to remain cooler during prolonged burning or, even more preferably, to cause the flame to lift-off entirely and extinguish. The tapered ports of FIGS. 49(*b*), (*c*) or (*d*) can be formed by applying higher concentration of etchant solution to one side of the metal sheet from which the air inlet plate 90 is constructed, until the ports are perforated to the required shape.

Figure 12:
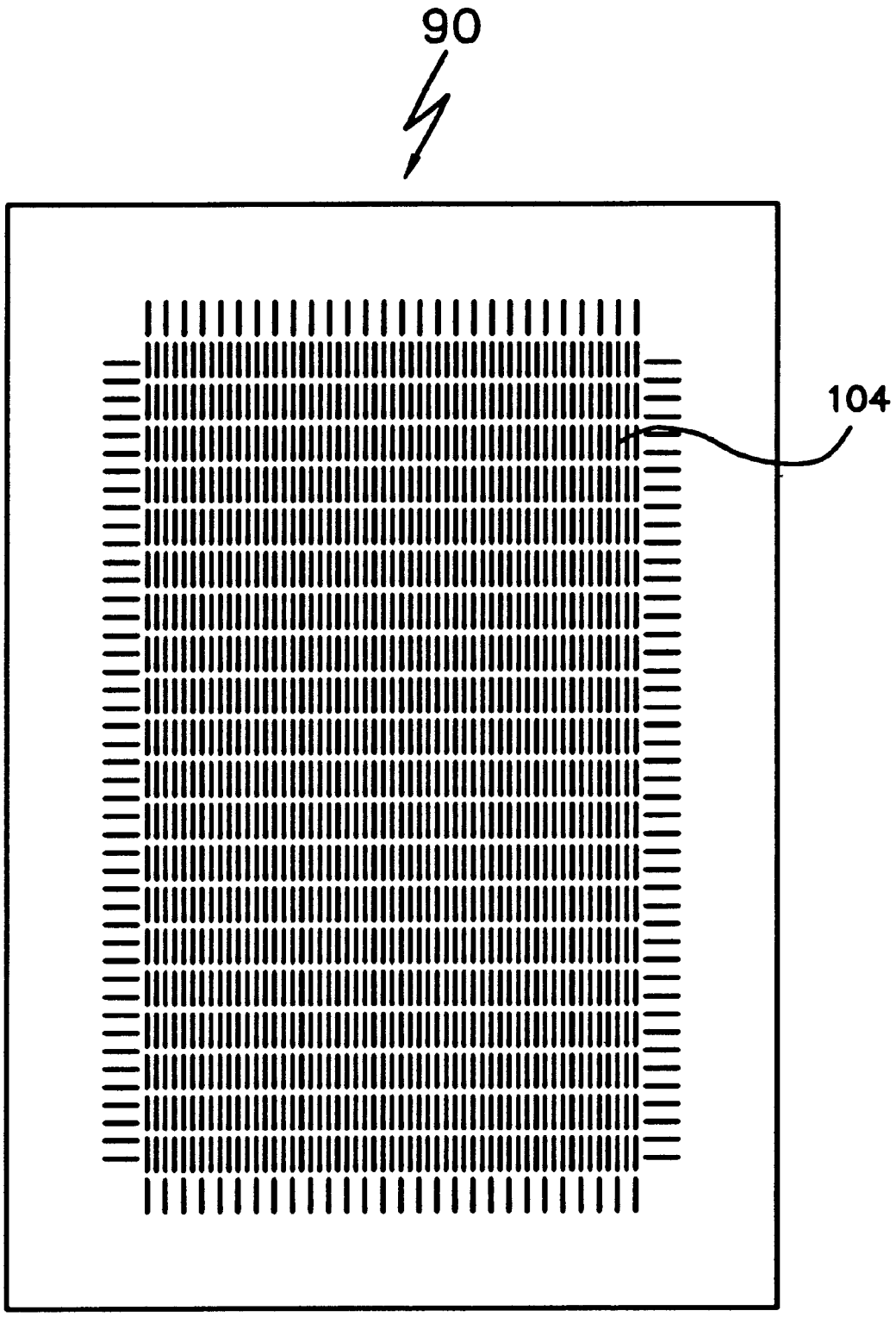
Figure 13A:
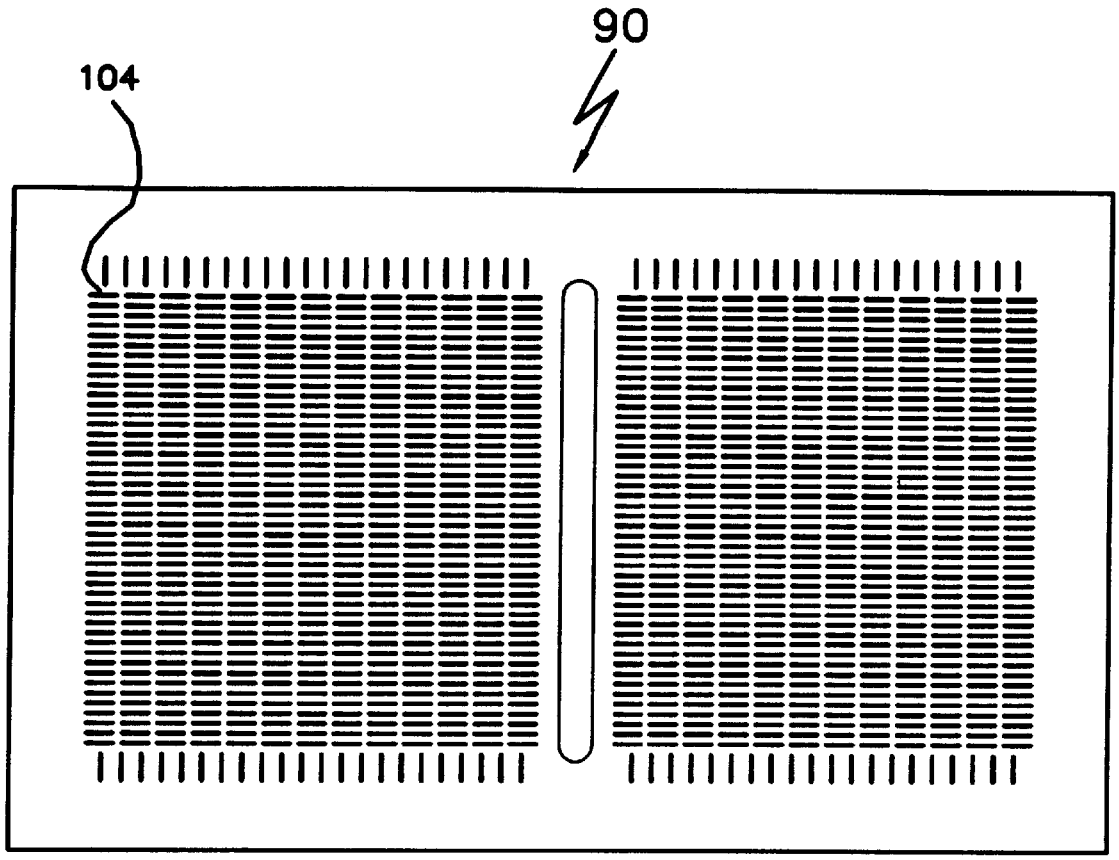
Figure 13B:
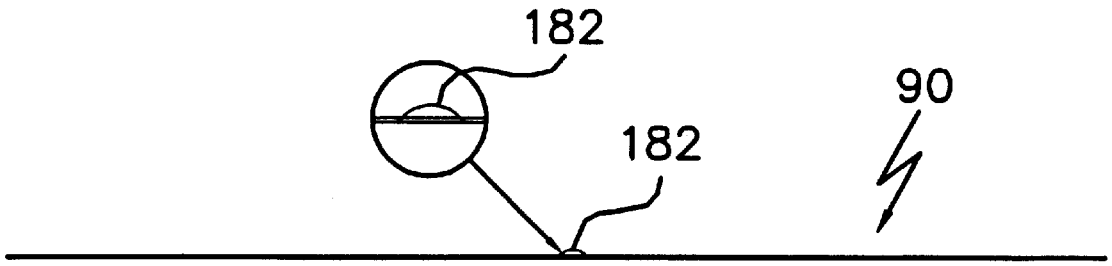
Figure 50A:
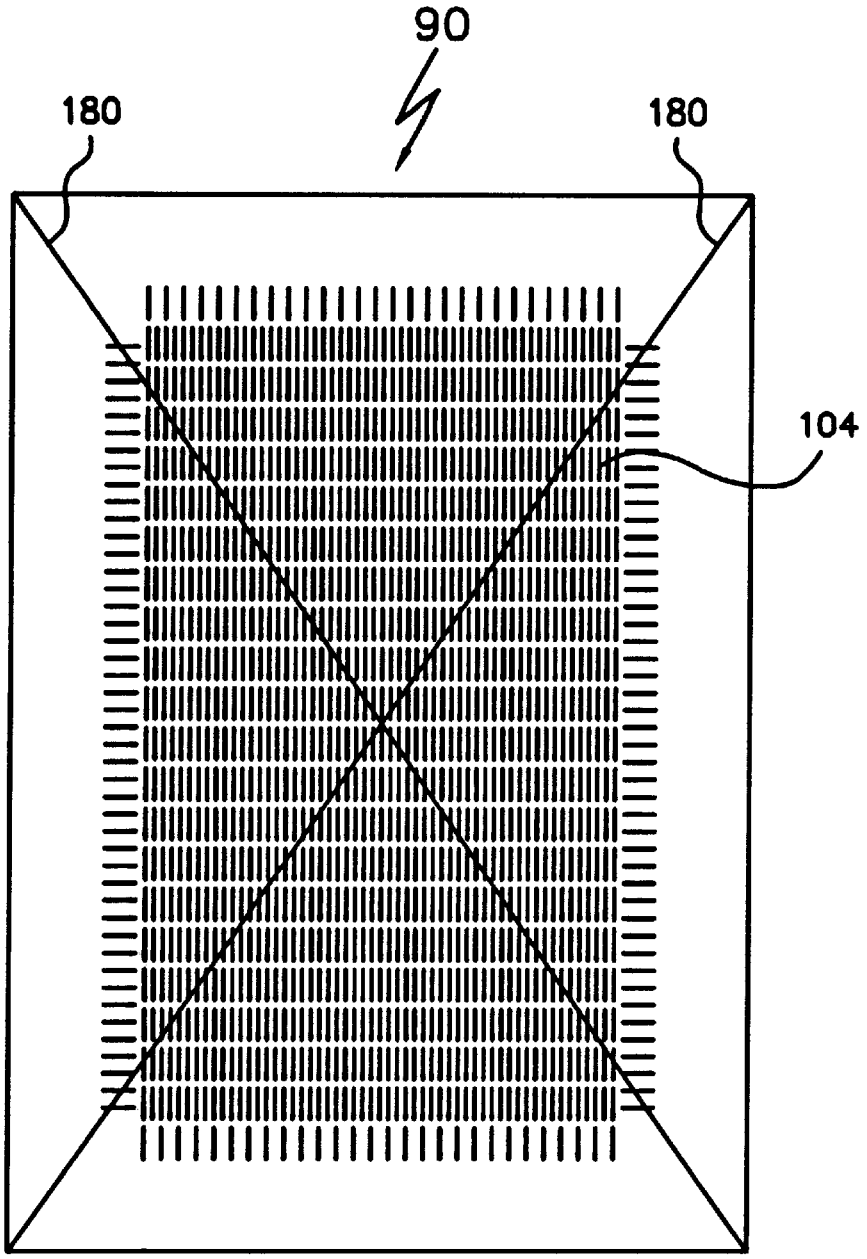
FIGS. 50(*a*) to (*c*) are three aspects of an air inlet plate stiffened by cross-broken diagonal folds.
Figure 50B:
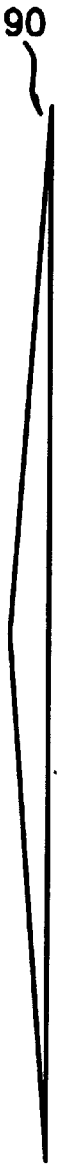
Figure 50C:
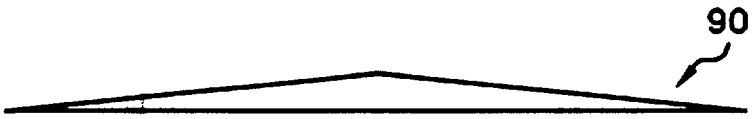

With reference to FIGS. 50(*a*), (*b*) and (*c*), the air inlet plate 90 with perforations 104 is provided with diagonal cross-breaking lines 180 which can provide the plate 90 with additional stiffness in order to change the natural frequency of the combination of the combustion chamber 75 and connected air inlet plate 90 to move that natural frequency away from a frequency of combustion process which may occur if extraneous fumes entering the air inlet chamber become ignited inside the combustion chamber 75. Depending on the frequency of combustion encountered for a particular design of water heater, the stiffened structure shown in FIGS. 50(*a*), (*b*) and (*c*) may be even more efficient than a corresponding flat air inlet plate 90 as illustrated in FIG. 12.

During prolonged burning incidents on the air inlet, the temperature rise inevitably experienced by the plate causes it to tend to expand or, if rigidly constrained by its attachment to the base of the combustion chamber, develops expansion stresses which tend to buckle the plate. We have found that a plate which is bowed as shown in FIG. 50(*a*) or with a similar bias or curvature in an upward or downward direction with respect to the plane of attachment to the combustion chamber base assists in avoiding undesirable buckling which may otherwise tend to either cause edge leakage or to create unwanted harmonic responses.

Figure 51A:
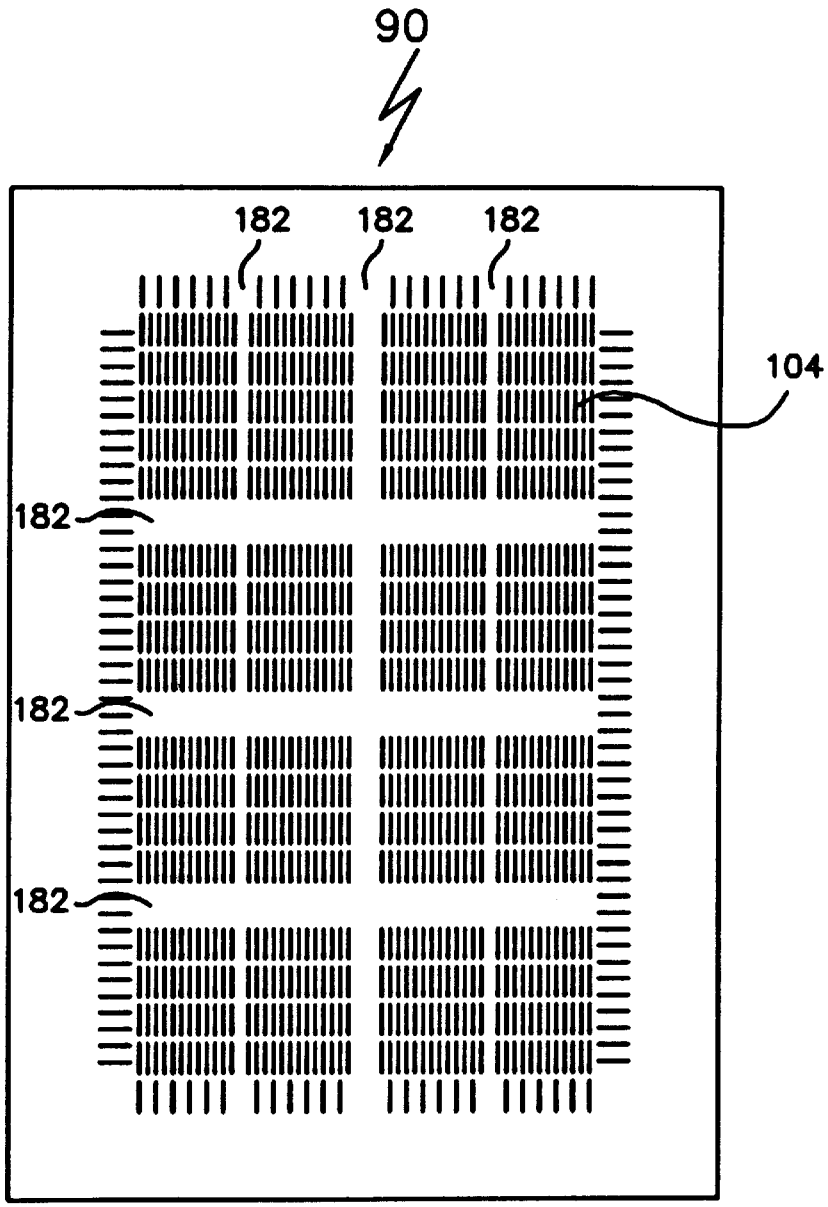
FIGS. 51(*a*) to (*c*) are three aspects of an air inlet plate stiffened and divided into separate perforated portions with stiffening formations between those separate portions.
Figure 51B:
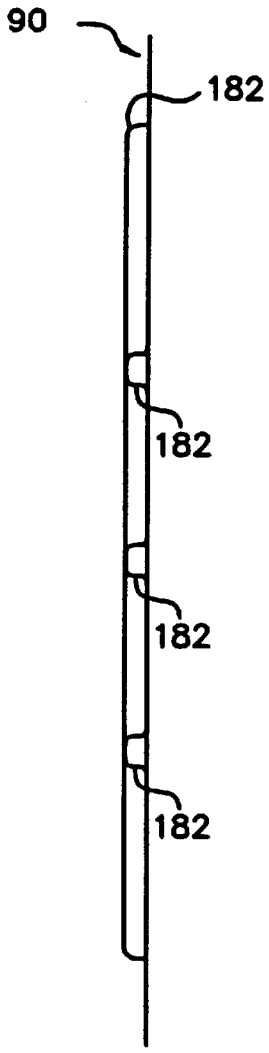
Figure 51C:
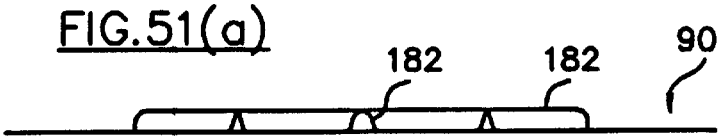

In FIGS. 51(*a*), (*b*) and (*c*) an air inlet plate 90 having slots 104 is shown having stiffening members extending at 90° to each edge of the plate 90. In the case of FIGS. 51(*a*), (*b*) and (*c*), the central perforated area as shown in FIG. 12 is altered by deleting a suitable number of rows of slots followed by the forming of one or more rounded channels 182 extending in one or more directions across the unperforated portions of the perforated area 100 of the plate 90. The stiffening of the plate 90 and the dividing of it into a number of smaller separated perforated areas by the rounded channels 182 causes both a change in the natural frequency of mechanical vibration of the structure of the combustion chamber in a particular water heater 62 with the air inlet plate 90 fitted and also changes the acoustic frequency of any combustion process that occurs at the air inlet plate 90 as a result of extraneous fumes entering the combustion chamber 75 and igniting.

Thus, the incorporation of a perforated plate 90 as illustrated in FIG. 51(*a*), (*b*) and (*c*) can be beneficial in providing an increased level of safety for a water heater of this invention. Any troublesome resonance during combustion can be reduced or prevented by stressing the base 86 of the combustion chamber 75 to change the natural frequency of the structure as a whole.

Figure 52:
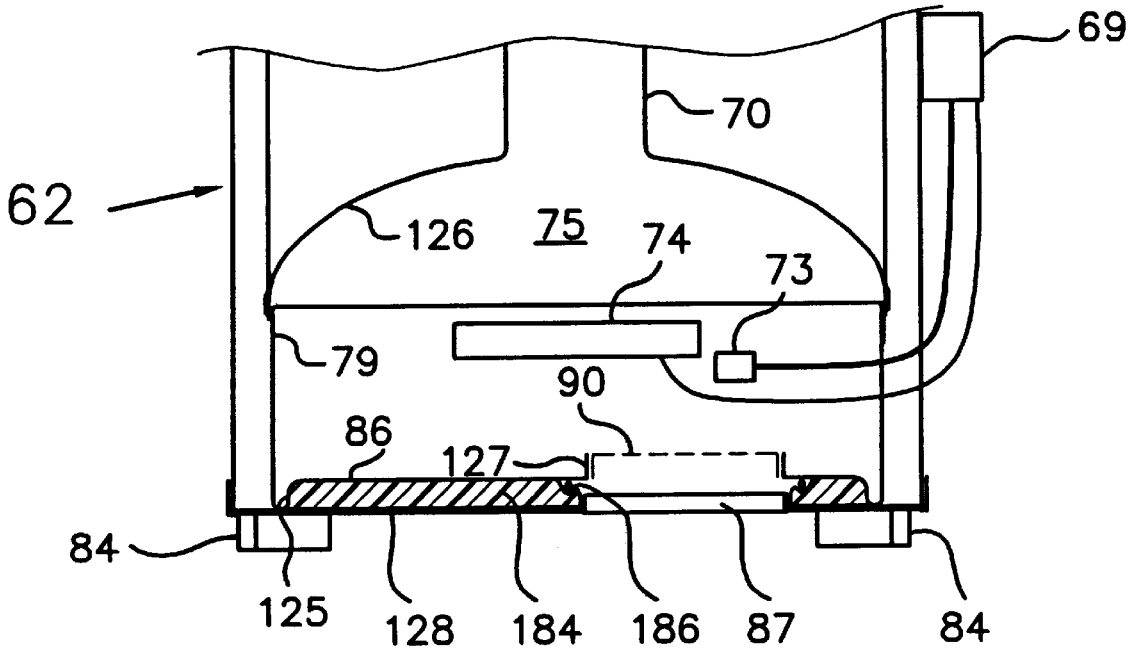
FIGS. 52–54 are schematic elevations of a bottom half of a water heater, each with an inlet plate mounted in the base of the combustion chamber, the base being dampened by contact with rigid or resilient damping materials sandwiched between the external surface of the combustion chamber and a pan forming the base of the water heater's protective jacket.
Figure 53:
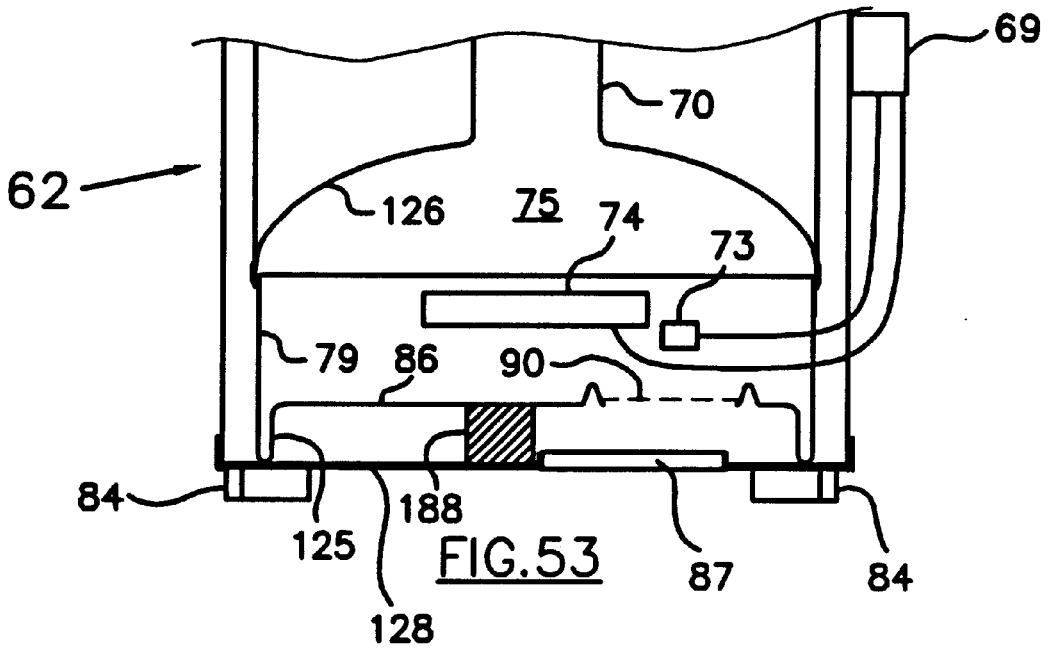
Figure 54:
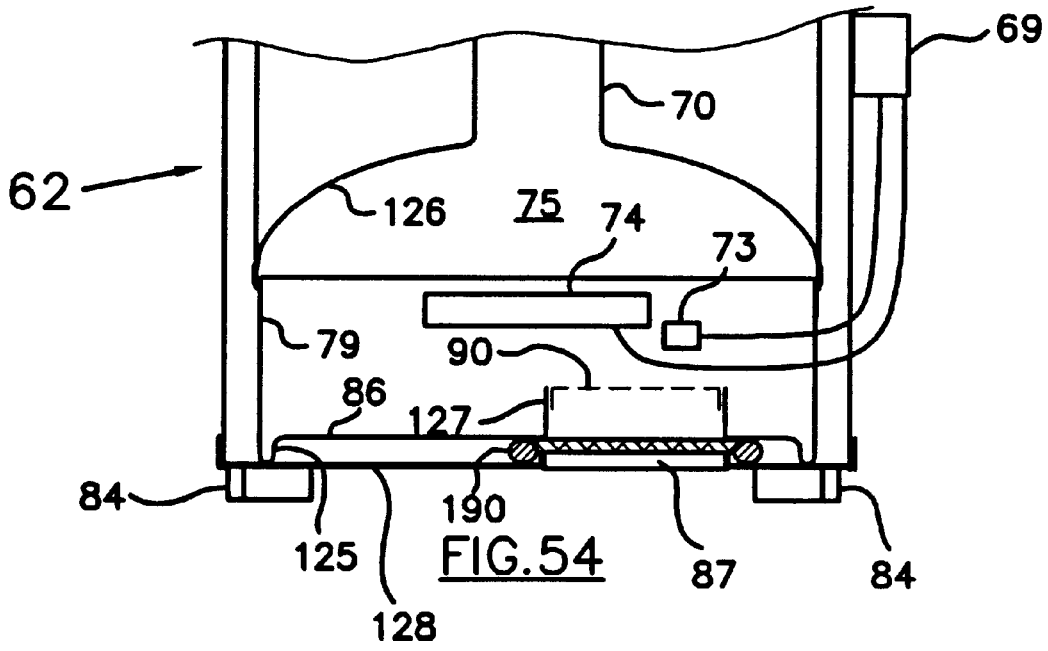

Approaches to make the structure effectively immune to troublesome acoustic problems are shown in FIGS. 52–54. In FIG. 52, the air inlet plate 90 mounted to the base 86 of the combustion chamber is separated from the support pan 128 by compressing a batt 184 of fibrous heat insulation such as, KAOWOOL (registered trade mark) and, adjacent the perimeter of the air inlet plate 90, a loop or, alternatively, for a rectangular shaped air inlet plate 90, two to four lengths, of fiberglass rope 186 under additional compression. This is one alternative form of rigidizing and muffling which particularly effectively damps combustion induced oscillation from exciting vibration of the water heater structure, further enhancing effectiveness.

Further alternative forms of rigidizing and muffling to the same effect are illustrated by reference to FIGS. 53 and 54. FIG. 53 shows an arrangement wherein a squat column 188 of rigid heat resistant material is inserted between base 86 and pan 128 during assembly of the water heater. The height of the column 188 is somewhat greater than the distance between the base 86 and pan 128 when those components are in their respective unstressed conditions so that the column 188 flexes the base 86 and pan 128 mutually away from each other.

FIG. 54 shows an analogous arrangement where a spool of compressed heat resistant cord 190, such as a woven fiberglass construction, is tightly sandwiched under compression between the base 86 and pan 128. Each of the arrangements shown in FIGS. 52–54 has been found to enable damping of combustion induced oscillation and are representative of other such effective arrangements. For example, in an arrangement similar in concept to FIG. 54, a length of fiberglass rope only about 5 cm (or 2 inches) long, tightly sandwiched between the base and pan as close as possible to the central axis of the water heater without blocking the air inlet path, was found to be effective.

It is to be understood that the invention disclosed and defined herein extends to all alternative combinations of two or more of the individual features mentioned or evident from the text or drawings. All of these different combinations constitute various alternative aspects of the invention.

The foregoing describes embodiments of the present invention and modifications, obvious to those skilled in the art, can be made to them without departing from the scope of the present invention.

What we claim is:

1. An air inlet for a water heater combustion chamber that is subject to exposure to extraneous fumes comprising a metal plate having a thickness of about 0.4 to 1 millimeter and through which pass a plurality of ports, each said port having a quenching distance not greater than about 0.6 mm, and being capable of confining ignition and combustion of said extraneous fume species within said combustion chamber.

2. The air inlet defined in claim 1, wherein said ports comprise slots.

3. The air inlet defined in claim 2, wherein said slots have an L/W ratio of between about 3 to about 20, wherein L is the length of said slots and W is the width of said slots.

4. The air inlet defined in claim 1, wherein said ports have a minimum distance between adjacent boundaries of about 1 mm.

5. The air inlet defined in claim 4, wherein said minimum distance between adjacent ports is substantially the same.

6. The air inlet defined in claim 1, wherein said ports are arranged in rows.

7. The air inlet defined in claim 6, wherein a first port in every alternate row has its location offset with respect to a port of an adjacent row.

8. The air inlet defined in claim 1, wherein said ports comprise slots arranged in rows in said inlet, with at least one peripheral row in said inlet comprising slots arranged parallel to each other and which have longitudinal axes at an angle of about 90° to the longitudinal axes of slots in other rows.

9. The air inlet defined in claim 1, wherein the ports are arranged in rows and one of said rows is a peripheral row having an interport spacing larger than that in others of said rows.

10. The air inlet defined in claim 1, wherein said ports comprise circular holes about 0.5 mm in diameter.

11. The air inlet defined in claim 9, wherein said interport spacing of the ports in said peripheral row is in the range of about 2 mm to 4 mm and the interport spacing of ports in remaining rows is in the range of about 1 mm to 1.5 mm.

12. The air inlet defined in claim 1, wherein the ports are arranged in a pattern comprising an aligned and spaced array.

13. The air inlet defined in claim 12, wherein the ports are arranged in a radial pattern.

14. The air inlet defined in claim 12, wherein the ports are arranged in a circumferential pattern.

15. The air inlet defined in claim 1, wherein said plate is constructed such that peak natural frequencies of vibration of said plate in combination with structure of combustion chamber are different from peak frequencies generated by an extraneous fume combustion process on the plate within the combustion chamber.

16. The air inlet defined in claim 1, wherein during combustion of said extraneous fumes over a prolonged period, a surface of said plate located outside of said combustion chamber remains sufficiently cool to prevent heating the extraneous fumes and air with it before it passes through said plate to a temperature above an ignition temperature of said extraneous fumes and air.

17. The air inlet defined in claim 1, wherein said ports are spaced apart on said plate by a distance which enables the temperature of mixtures of extraneous fumes with air adjacent to the surface of the walls of said ports to remain below the ignition temperature of said mixtures.

18. The air inlet defined in claim 1, wherein said plate comprises a ferrous based material.

19. The air inlet defined in claim 1, wherein said ports are formed in said plate by a photochemical machining process.

20. The air inlet defined in claim 1, wherein the metal plate is deformed from a flat form to include stiffening members extending across at least a portion containing said plurality of ports.

21. The air inlet defined in claim 20, wherein said stiffening members intersect with ports.

22. The air inlet defined in claim 20, wherein the metal plate is deformed from a flat form to include stiffening members extending across non-ported portions which subdivide said plurality of ports into an integral number of sub-portions.

23. An air inlet for a water heater combustion chamber that is subject to exposure to extraneous fumes comprising a ceramic plate having a thickness in the range about 9 mm to 12 mm through which pass a plurality of ports each having a quenching distance of 1.1 to 1.3 mm, and being capable of confining ignition and combustion of said extraneous fume species within said combustion chamber.

24. The air inlet defined in claim 23, wherein said ports comprise slots.

25. The air inlet defined in claim 24, wherein said slots have an L/W ratio of between about 3 to about 20, wherein L is the length of said slots and W is the width of said slots.

26. The air inlet defined in claim 23, wherein there is a substantially equal minimum distance between adjacent ports.

27. The air inlet defined in claim 23, wherein said ports are arranged in rows.

28. The air inlet defined in claim 27, wherein a first port in every alternate row is offset with respect to a port of an adjacent row.

29. The air inlet defined in claim 23, wherein said ports comprise circular holes having a quenching distance which is a diameter of about 1.1 to 1.3 mm.

30. An air inlet for a water heater combustion chamber that is subject to exposure to extraneous fumes comprising a woven metal mesh having transverse wires of thickness about 0.2 to 0.5 millimeters defining a plurality of ports, each said port having a quenching distance equal to the greater of the side lengths of four-sided open areas between said wires and in the range of about 0.3 to 0.5 mm, and being capable of confining ignition and combustion of said extraneous fume species within said combustion chamber.

* * * * *